US012404141B2

(12) United States Patent
Yanai et al.

(10) Patent No.: US 12,404,141 B2
(45) Date of Patent: Sep. 2, 2025

(54) MEDIUM PROCESSING APPARATUS, IMAGE FORMING SYSTEM, MEDIUM PROCESSING METHOD, AND NON-TRANSITORY RECORDING MEDIUM

(71) Applicants: Yuta Yanai, Kanagawa (JP); Yuji Susaki, Kanagawa (JP)

(72) Inventors: Yuta Yanai, Kanagawa (JP); Yuji Susaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 18/343,043

(22) Filed: Jun. 28, 2023

(65) Prior Publication Data

US 2024/0034592 A1 Feb. 1, 2024

(30) Foreign Application Priority Data

Jul. 29, 2022 (JP) ..... 2022-121881
May 25, 2023 (JP) ..... 2023-086434

(51) Int. Cl.
*B65H 37/04* (2006.01)

(52) U.S. Cl.
CPC ... *B65H 37/04* (2013.01); *B65H 2301/43828* (2013.01)

(58) Field of Classification Search
CPC ..... B65H 2301/43828; B65H 2301/51616; B65H 2405/1134; B65H 37/04
See application file for complete search history.

(56) References Cited

U.S. PATENT DOCUMENTS 5,639,078 A * 6/1997 Mandel ..... B65H 31/34 271/223
7,597,312 B2 * 10/2009 Nishioka ..... B42C 1/12 270/58.11
2015/0239587 A1 * 8/2015 Abe ..... G03G 15/6541 100/7
2015/0338814 A1 * 11/2015 Shirasaki ..... B65H 31/02 412/33
2017/0217239 A1 8/2017 Suzuki et al.
2020/0172368 A1 6/2020 Susaki et al.
2022/0371849 A1 11/2022 Susaki
2022/0380165 A1 12/2022 Yanai

FOREIGN PATENT DOCUMENTS

JP 2017-136732 8/2017
JP 2018-043842 3/2018
JP 2018-043844 3/2018

* cited by examiner

*Primary Examiner* — Jennifer Bahls
(74) *Attorney, Agent, or Firm* — IPUSA, PLLC

(57) ABSTRACT

A medium processing apparatus includes a conveyor, a receptacle, an aligner, a crimp binder, and circuitry. The conveyor conveys a medium. The receptacle holds the medium. The aligner contacts a downstream end of the medium and aligns a position of the medium in a conveyance direction of the medium. The crimp binder faces the downstream end of the medium to press and deform a binding position on media of which the position is aligned, to bind the media. The aligner and the crimp binder are movable in a main scanning direction orthogonal to each of the conveyance direction and a thickness direction of the medium. When determining that the aligner overlaps the binding position when the receptacle is viewed in the thickness direction, the circuitry moves the aligner in the main scanning direction away from the binding position and causes the crimp binder to crimp and bind the media.

13 Claims, 16 Drawing Sheets

MEDIUM PROCESSING APPARATUS, IMAGE FORMING SYSTEM, MEDIUM PROCESSING METHOD, AND NON-TRANSITORY RECORDING MEDIUM

CROSS-REFERENCE TO RELATED APPLICATIONS

This patent application is based on and claims priority pursuant to 35 U.S.C. § 119(a) to Japanese Patent Application Nos. 2022-121881, filed on Jul. 29, 2022, and 2023-086434, filed on May 25, 2023, in the Japan Patent Office, the entire disclosure of each of which is hereby incorporated by reference herein.

BACKGROUND

Technical Field

Embodiments of the present disclosure relate to a medium processing apparatus, an image forming system, a medium processing method, and a non-transitory recording medium.

Related Art

Medium processing apparatuses are known in the related art that bind, into a bundle, sheet-shaped media on which images are formed by image forming apparatuses. Since sheets of paper are widely known as an example of sheet-shaped media, a "sheet bundle" that is a stack of sheets of paper is used as an example of a bundle of sheet-shaped media in the following description. Some medium processing apparatuses include a crimper that can perform so-called "crimp binding" without metal binding needles from a viewpoint of resource saving and reduction in environmental load. Specifically, the crimper sandwiches a sheet bundle with serrate binding teeth to press and deform the sheet bundle.

SUMMARY

According to an embodiment of the present disclosure, a medium processing apparatus includes a conveyor, a receptacle, a conveyance-direction aligner, a crimp binder, and circuitry. The conveyor conveys a sheet-shaped medium in a conveyance direction. The receptacle holds the medium conveyed by the conveyor. The conveyance-direction aligner contacts a downstream end, in the conveyance direction, of the medium placed on the receptacle and aligns a position, in the conveyance direction, of the medium. The crimp binder is disposed to face the downstream end, in the conveyance direction, of the medium placed on the receptacle to press and deform a binding position on a plurality of media, including the medium, of which the position in the conveyance direction is aligned by the conveyance-direction aligner, to bind the plurality of media. The circuitry controls operations of the conveyor, the conveyance-direction aligner, and the crimp binder. The conveyance-direction aligner and the crimp binder are movable in a main scanning direction orthogonal to each of the conveyance direction and a thickness direction of the medium placed on the receptacle. The circuitry determines whether the conveyance-direction aligner overlaps the binding position when the receptacle is viewed in the thickness direction. In a case where the circuitry determines that the conveyance-direction aligner overlaps the binding position when the receptacle is viewed in the thickness direction, the circuitry moves the conveyance-direction aligner in the main scanning direction to a position away from the binding position. The circuitry then causes the crimp binder to crimp and bind the plurality of media.

According to an embodiment of the present disclosure, a novel image forming system includes an image forming apparatus and the medium processing apparatus. The image forming apparatus forms an image on a medium. The medium processing apparatus crimps and binds a plurality of media, including the medium, on each of which the image is formed by the image forming apparatus.

According to an embodiment of the present disclosure, a novel medium processing method includes determining whether a conveyance-direction aligner overlaps a binding position when a receptacle is viewed in a thickness direction of a medium, moving the conveyance-direction aligner in a main scanning direction to a position away from the binding position based on a determination that the conveyance-direction aligner overlaps the binding position when the receptacle is viewed in the thickness direction of the medium, the main scanning direction being a direction orthogonal to each of a conveyance direction of the medium and the thickness direction of the medium placed on the receptacle, and moving a crimp binder in the main scanning direction and causing the crimp binder to crimp and bind a plurality of media including the medium.

According to an embodiment of the present disclosure, a novel non-transitory recording medium stores a plurality of instructions which, when executed by one or more processors, causes the processors to perform the medium processing method.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
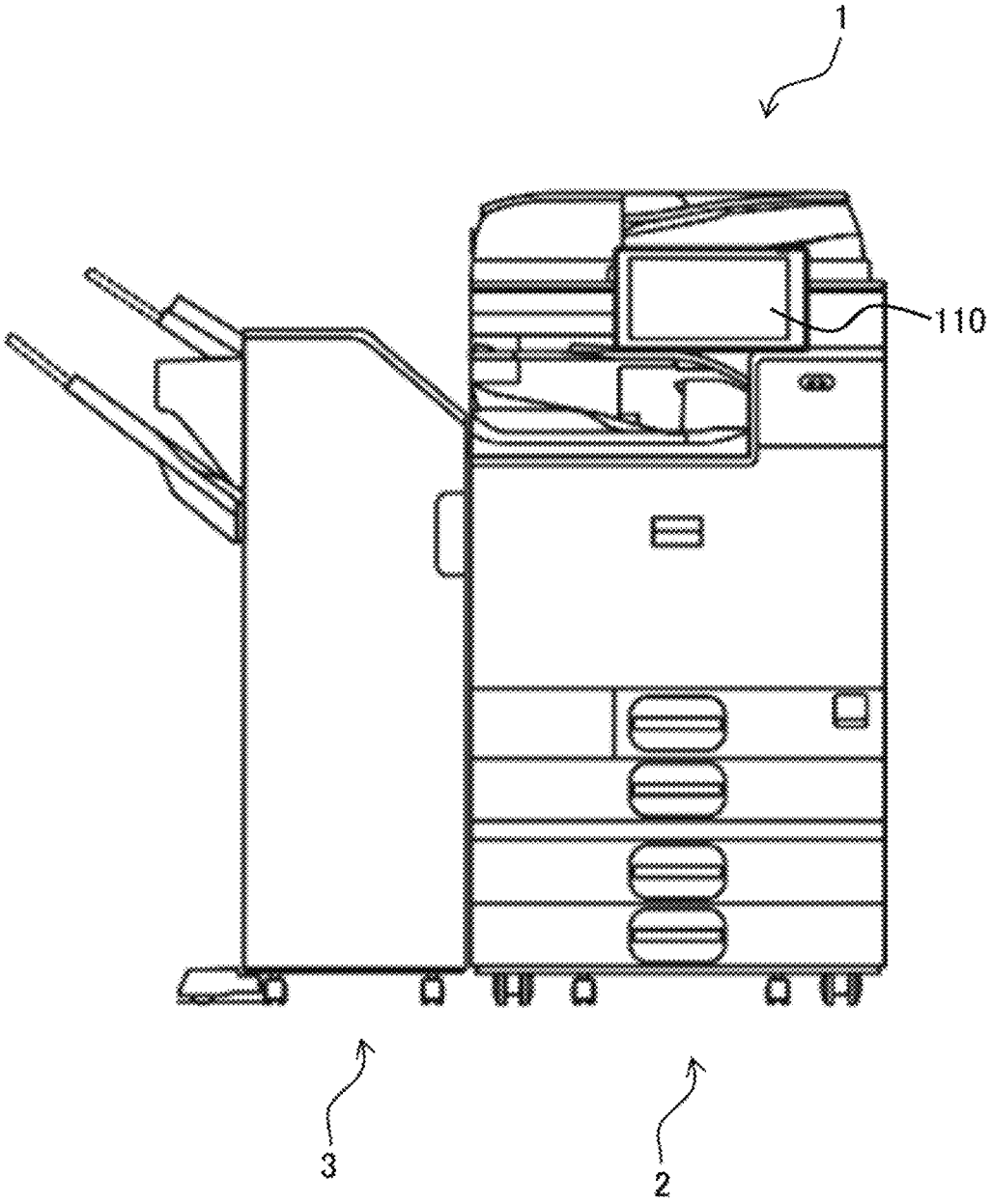
FIG. 1 is a diagram illustrating the overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below.

As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

As used herein, the term "connected-coupled" includes both direct connections and connections in which there are one or more intermediate connecting elements.

With reference to the drawings, a description is now given of an image forming system 1 according to an embodiment of the present disclosure.

FIG. 1 is a diagram illustrating the overall configuration of the image forming system 1.

The image forming system 1 has a function of forming an image on a sheet P as a sheet-shaped medium and performing post-processing on the sheet P on which the image is formed. As illustrated in FIG. 1, the image forming system 1 includes an image forming apparatus 2 and a post-processing apparatus 3 serving as a medium processing apparatus.

The image forming apparatus 2 forms an image on the sheet P and outputs the sheet P bearing the image to the post-processing apparatus 3. The image forming apparatus 2 includes a tray that accommodates the sheet P, a conveyor that conveys the sheet P accommodated in the tray, and an image forming device that forms an image on the sheet P conveyed by the conveyor. The image forming device may be an inkjet image forming device that forms an image with ink or an electrophotographic image forming device that forms an linage with toner. Since the image forming apparatus 2 has a typical configuration, a detailed description of the configuration and functions of the image forming apparatus 2 will be omitted unless otherwise required.

Figure 2:
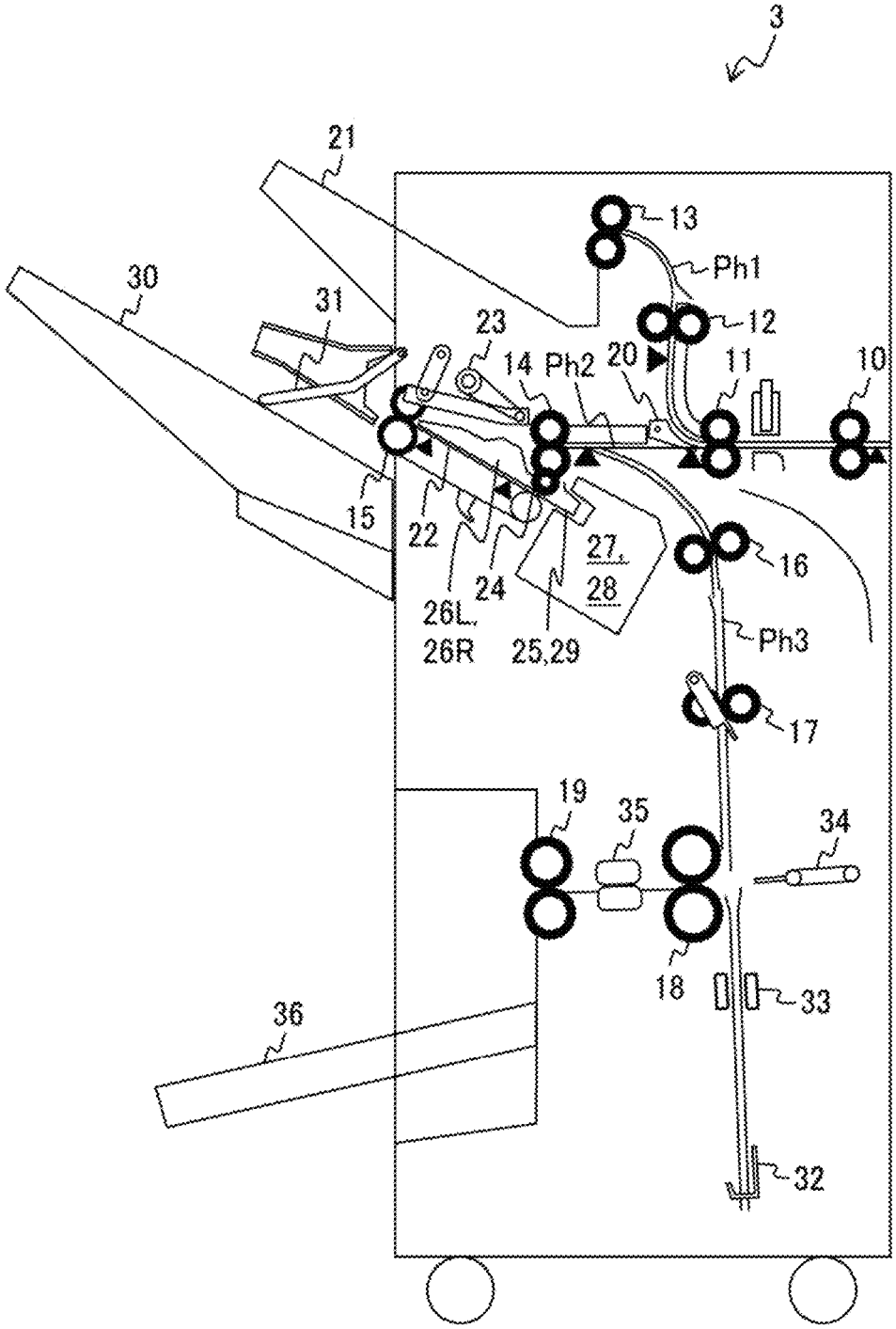
FIG. 2 is a diagram illustrating an internal configuration of a post-processing apparatus in the image forming system of FIG. 1.

FIG. 2 is a diagram illustrating an internal configuration of the post-processing apparatus 3.

The post-processing apparatus 3 performs post-processing on the sheet P on which an image is formed by the image forming apparatus 2. The post-processing according to the present embodiment is binding as a process to bind the sheets P on each of which an image is formed as a bundle of sheets P. In the following description, the bundle of sheets P may be referred to as a "sheet bundle Pb" serving as a bundle of media. More specifically, the binding according to the present embodiment includes so-called "crimp binding" and "stabling." The crimp binding is a process to press and deform the sheet bundle Pb to bind the sheet bundle Pb. The stapling is a process to pass a staple through the sheet bundle Pb to bind the sheet bundle Pb. The binding includes edge binding and saddle binding. The edge binding is a process to bind an end (including an edge) of the sheet bundle Pb. The saddle binding is a process to bind the center of the sheet bundle Pb.

The post-processing apparatus 3 includes conveyance roller pairs 10 to 19 serving as conveyors and a switching claw 20. The conveyance roller pairs 10 to 19 convey, inside the post-processing apparatus 3, the sheet P supplied from the image forming apparatus 2. More specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3.

The first conveyance passage Ph1 is a passage extending to a first output tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to a second output tray 30 via an internal tray 22. The third conveyance passage Ph3 is a passage branching from the first conveyance passage Ph1 between the conveyance roller pairs 11 and 14 in the conveyance direction and extending to a third output tray 36.

The switching claw 20 is disposed at a branching position of the first conveyance passage Ph1 and the second conveyance passage Ph2.

The switching claw 20 can be switched between a first position and a second position. The switching claw 20 in the first position guides the sheet P to be output to the first output tray 21 through the first conveyance passage Ph1. The switching claw 20 in the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in the reverse direction to guide the sheet P to the third conveyance passage Ph3. The post-processing apparatus 3 further includes a plurality of sensors that detects the positions of the sheet P in the first conveyance passage Ph1, the second conveyance passage Ph2, and the third conveyance passage Ph3. Each of the plurality of sensors is indicated by a black triangle mark in FIG. 2.

The post-processing apparatus 3 includes the first output tray 21. The sheet P output through the first conveyance passage Ph1 is placed on the first output tray 21. Among the sheets P supplied from the image forming apparatus 2, the sheets P that are not bound are output to the first output tray 21.

The post-processing apparatus 3 further includes the internal tray 22 serving as a receptacle, a tapping roller 23 serving as a contact and separation device, a return roller 24, an end fence 25 serving as a conveyance-direction aligner, side fences 26L and 26R serving as width-direction aligners, a crimp binder 27, a stapling unit 28, a release claw 29 serving as a releaser, the second output tray 30, and a filler 31. The internal tray 22, the tapping roller 23, the return roller 24, the end fence 25, the side fences 26L and 26R, the crimp binder 27, the stapling unit 28, and the release claw 29 perform the edge binding on the sheet bundle Pb constructed of the sheets P conveyed through the second conveyance passage Ph2. Among the sheets P supplied from the image forming apparatus 2, the sheet bundle Pb subjected to the edge binding is output to the second output tray 30.

The "edge binding" includes "parallel binding," "oblique binding," and "vertical binding." The "parallel binding" is a process to bind the sheet bundle Pb along one side of the sheet bundle Pb parallel to a main scanning direction. The "oblique binding" is a process to bind a corner of the sheet bundle Pb. The "vertical binding" is a process to bind the sheet bundle Pb along one side of the sheet bundle Pb parallel to the conveyance direction.

In the following description, a direction in which the sheet P is conveyed from the conveyance roller pair 15 toward the end fence 25 is defined as a "conveyance direction" of the sheet P. In other words, the "conveyance direction" corresponds to a direction in which the sheet P that has been output from the image forming apparatus 2 is moved toward the end fence 25 by the conveyance roller pair 15 after being moved toward the second output tray 30 by, for example, the conveyance roller pair 10. A direction that is orthogonal to each of the conveyance direction and a thickness direction of the sheet P is defined as a "main scanning direction" or a "width direction of the sheet P."

The internal tray 22 is disposed downstream from the conveyance roller pair 15 in the conveyance direction. The sheets P that are sequentially conveyed through the second conveyance passage Ph2 are temporarily placed on the internal tray 22 serving as a receptacle. The internal tray 22 according to the present embodiment is inclined downward in the conveyance direction. The tapping roller 23 is rotatably held at an end of a rotary arm above the internal tray 22. The tapping roller 23 comes into contact with and separates from the uppermost sheet P placed on the internal tray 22 by the rotation of the rotary arm. The return roller 24 is disposed above the internal tray 22, downstream from the tapping roller 23 in the conveyance direction.

When the rotary arm is pivoted in a direction in which the tapping roller 23 is separated from the internal tray 22, the sheet P conveyed in the conveyance direction by the conveyance roller pair 15 enters the internal tray 22. In this state, when the rotary arm is pivoted in a direction in which the tapping roller 23 approaches the internal tray 22, the tapping roller 23 abuts, from above, against the sheet P conveyed onto the internal tray 22 by the conveyance roller pair 15. The sheet P in contact with the tapping roller 23 is separated from the conveyance roller pair 15 and placed on the internal tray 22. The return roller 24 contacts the upper face of the sheet P placed on the internal tray 22 and rotates to guide the sheet P toward the end fence 25.

The end fence 25 is disposed downstream from the internal tray 22 in the conveyance direction. The end fence 25 is movable in the main scanning direction along the surface of the sheet P or the sheet bundle Pb placed on the internal tray 22. The end fence 25 contacts a downstream end, in the conveyance direction, of the sheet P or the sheet bundle Pb placed on the internal tray 22 to align the downstream end, in the conveyance direction, of the plurality of sheets P of the sheet bundle Pb. The side fences 26L and 26R are disposed on opposed sides on the internal tray 22 in the main scanning direction. The side fences 26L and 26R are movable in the main scanning direction. The side fences 26L and 26R contact opposed ends, in the main scanning direction, of the sheet P or the sheet bundle Pb placed on the internal tray 22 to align the ends, in the main scanning direction, of the plurality of sheets P of the sheet bundle Pb.

The crimp binder 27 and the stapling unit 28 are disposed downstream from the internal tray 22 in the conveyance direction. The crimp binder 27 and the stapling unit 28 are independently movable in the main scanning direction along the surface of the sheet P the sheet bundle Pb placed on the internal tray 22. The crimp binder 27 and the stapling unit 28 perform the edge binding on an end of the sheet bundle Pb aligned by the end fence 25 and the side fences 26L and 26R.

More specifically, the crimp binder 27 sandwiches the binding position on the sheet bundle Pb placed on the internal tray 22 with senate binding teeth from both sides in the thickness direction. As a result, the binding position on the sheet bundle Pb is pressed and deformed. Thus, the sheet bundle Pb is crimped and bound.

Figure 3:
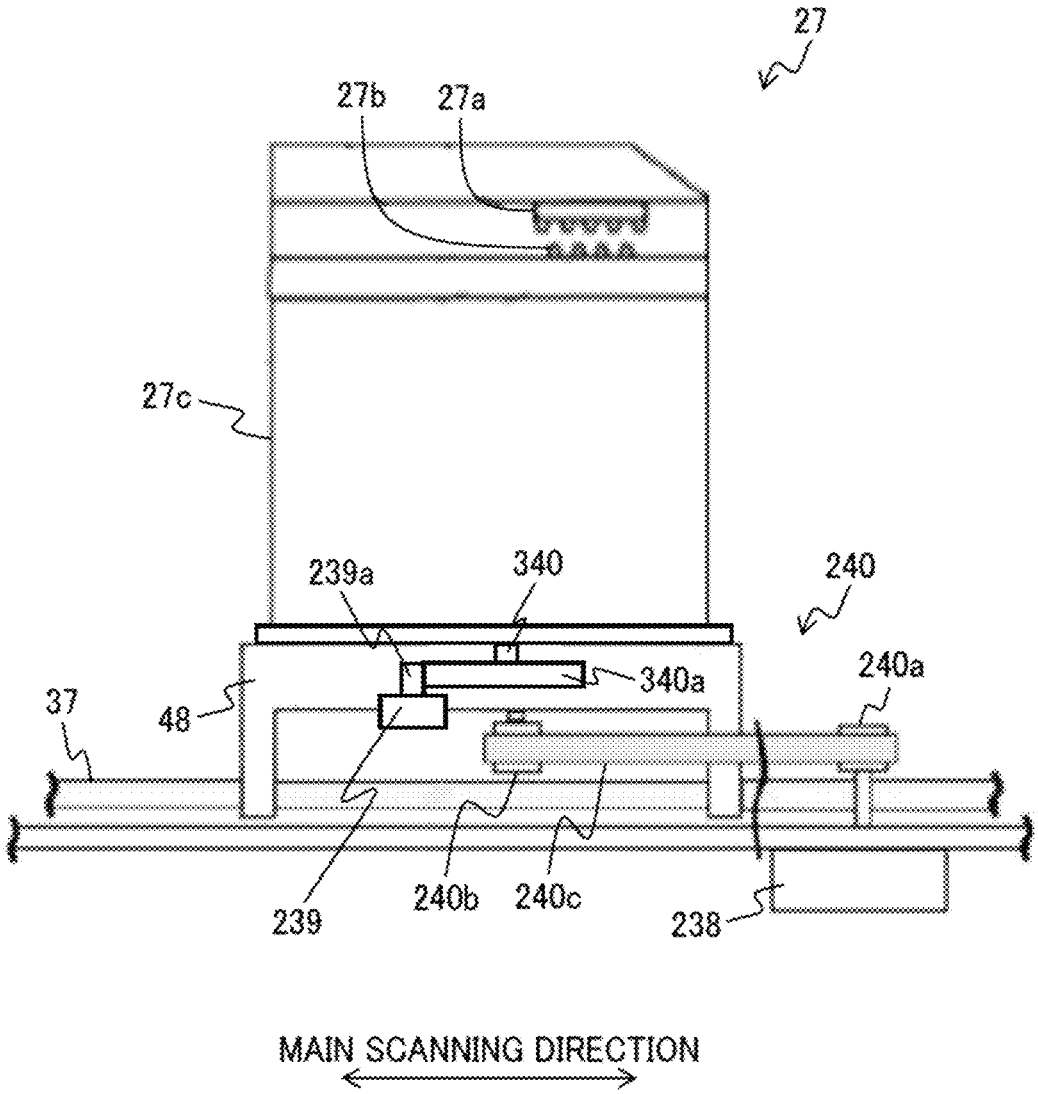
FIG. 3 is a schematic view of an upstream side of a crimp binder of the post-processing apparatus of FIG. 2 in a conveyance direction.

FIG. 3 is a schematic view of an upstream side of the crimp binder 27 in the conveyance direction.

As illustrated in FIG. 3, a guide shaft 37 extends in the main scanning direction at a position downstream from the internal tray 22 in the conveyance direction. The crimp binder 27 is moved in the main scanning direction along the surface of the sheet bundle Pb placed on the internal tray 22, in other words, along the guide shaft 37, by a driving force that is transmitted from a crimper movement motor 238 by a driving force transmission assembly 240 including pulleys 240*a* and 240*b* and a timing belt 240*c*. A crimper shaft 340 provided with a drive transmission gear 340*a* is fixed to a bottom face of a crimping frame 27*c* that holds the components of the crimp binder 27 such as upper crimping teeth 27*a* and lower crimping teeth 27*b*. The crimper shaft 340 and the drive transmission gear 340*a* are held by a base 48 on which the crimping frame 27*c* is disposed, so as to be rotatable in the forward and reverse directions. The drive transmission gear 340*a* meshes with an output gear 239*a* of a crimper pivot motor 239. The crimp binder 27 is rotated in the forward and reverse directions on the base 48 about the crimper shaft 340 extending in the thickness direction of the sheet P placed on the internal tray 22, by a driving force transmitted from the crimper pivot motor 239 to the crimper shaft 340 via the output gear 239*a* and the drive transmission gear 340*a*. The guide shaft 37, the crimper movement motor 238, the crimper pivot motor 239, the crimper shaft 340, and the driving force transmission assembly 240 construct a driving assembly of the crimp binder 27.

Figure 4A:
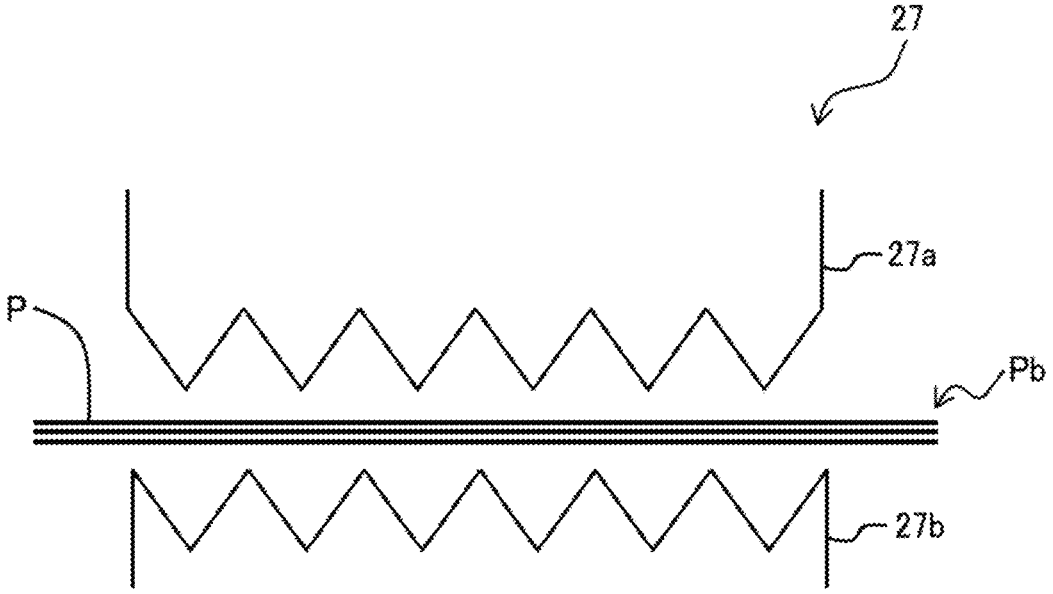
FIGS. 4A and 4B are schematic diagrams illustrating a configuration of the crimp binder of FIG. 3.
Figure 4B:
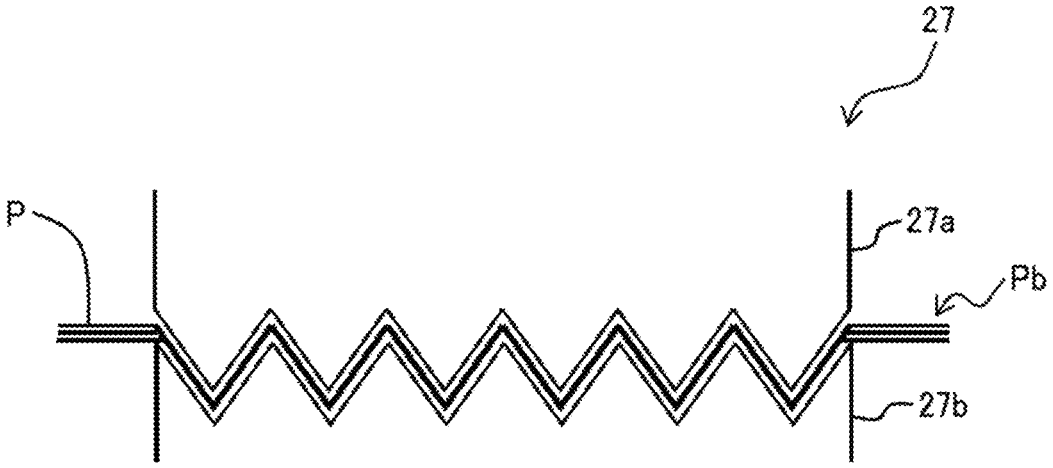

As illustrated in FIGS. 4A and 4B, the crimp binder 27 includes a pair of binding teeth (i.e., the upper crimping teeth 27*a* and the lower crimping teeth 27*b*). The upper crimping teeth 27*a* and the lower crimping teeth 27*b* are disposed to face each other in the thickness direction of the sheet bundle Pb so as to sandwich the sheet bundle Pb placed on the internal tray 22. The upper crimping teeth 27*a* and the lower crimping teeth 27*b* have respective serrate faces facing each other. The senate face of each of the upper crimping teeth 27*a* and the lower crimping teeth 27*b* includes concave portions and convex portions alternately formed. The concave portions and the convex portions of the upper crimping teeth 27*a* are shifted from those of the lower crimping teeth 27*b* such that the upper crimping teeth 27*a* are engaged with the lower crimping teeth 27*b*. The upper crimping teeth 27*a* and the lower crimping teeth 27*b* are brought into contact with and separated from each other by a driving force of a contact-separation motor 27*d* illustrated in FIG. 7.

In the process of supplying the sheets P of the sheet bundle Pb to the internal tray 22, the upper crimping teeth 27*a* and the lower crimping teeth 27*b* are apart from each other as illustrated in FIG. 4A. When all the sheets P of the sheet bundle Pb are placed on the internal tray 22, the upper crimping teeth 27*a* and the lower crimping teeth 27*b* are engaged with each other to press and deform the sheet bundle Pb in the thickness direction as illustrated in FIG. 4B. As a result, the sheet bundle Pb that has been placed on the internal tray 22 is crimped and bound. The sheet bundle Pb thus crimped and bound is output to the second output tray by the conveyance roller pair 15.

The configuration of the crimp binder 27 as a crimping assembly is not limited to the configuration of a moving assembly exemplified in the present embodiment, provided that the upper crimping teeth 27*a* and the lower crimping teeth 27*b* of the crimping assembly are engaged with each other. For example, the crimping assembly may be a crimping assembly disclosed in Japanese Patent No. 6057167 or its corresponding U.S. Patent Application Publication No. 2014-0219747, which is hereby incorporated by reference as though disclosed herein in its entirety. In this case, the crimping assembly brings the upper crimping teeth 27*a* and the lower crimping teeth 27*b* into contact with each other and separates the upper crimping teeth 27*a* and the lower crimping teeth 27*b* from each other with a link assembly and a driving source that simply rotates forward or that rotates forward and backward. Alternatively, the crimping assembly may employ a linear motion system to linearly bring the upper crimping teeth 27*a* and the lower crimping teeth 27*b* into contact with each other and separate the upper crimping teeth 27*a* and the lower crimping teeth 27*b* from each other with a screw assembly that converts the forward and backward rotational motions of a driving source into linear reciprocating motion.

Now, a detailed description is given of the stapling unit 28.

The stapling unit 28 executes stapling or a stapling process. Specifically, the stapling unit 28 passes a staple through a binding position on the sheet bundle Pb placed on the internal tray 22 to bind the sheet bundle Pb.

Figure 5:
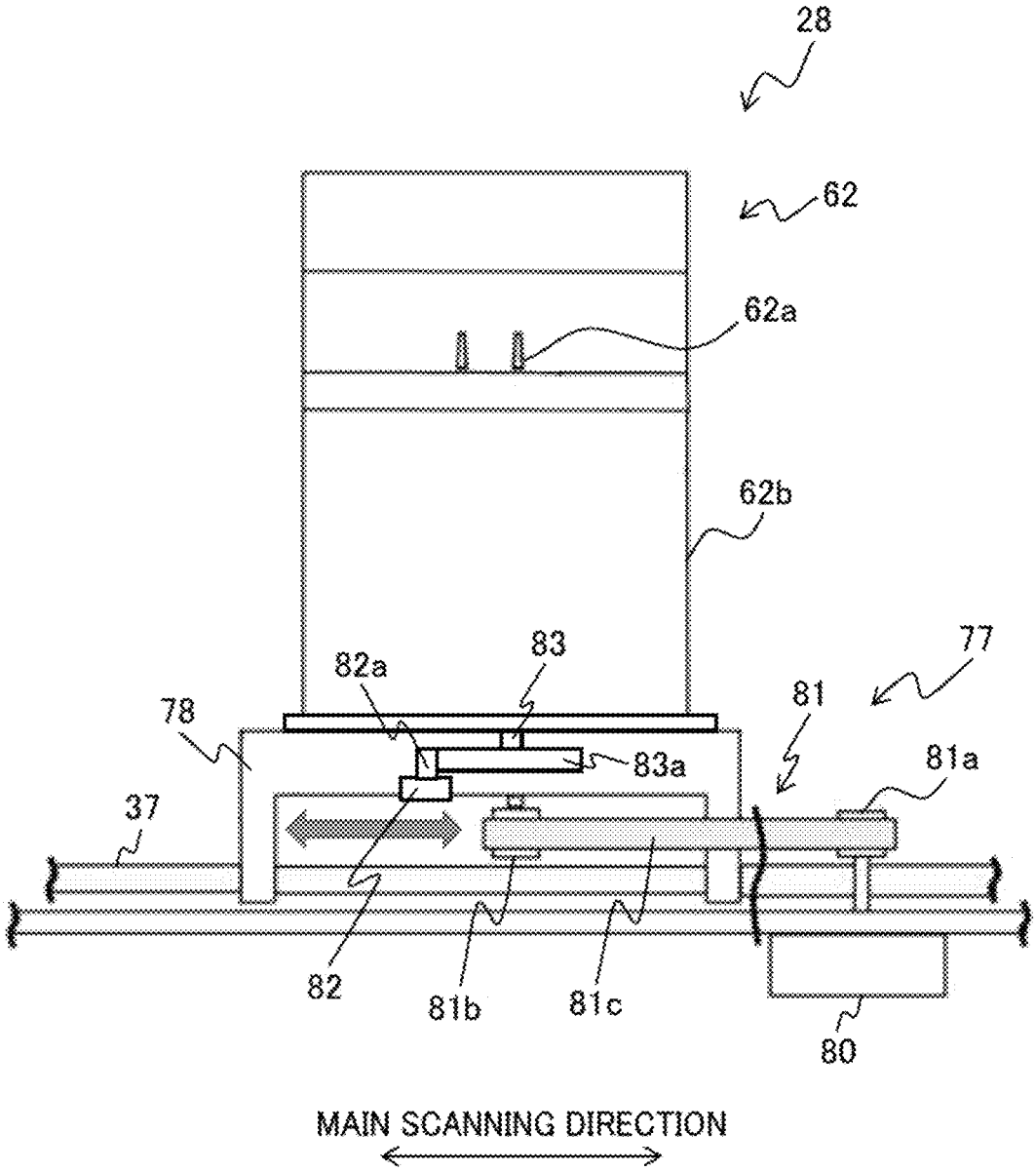
FIG. 5 is a schematic view of a downstream upstream side of a stapling unit of the post-processing apparatus of FIG. 2 in a conveyance direction.

FIG. 5 is a schematic view of a downstream side of the stapling unit 28 in the conveyance direction.

The stapling unit 28 includes a stapler 62 that binds the sheet bundle Pb with a staple or staples. The stapler 62 is disposed downstream from the internal tray 22 in the conveyance direction and apart from the crimp binder 27 in the main scanning direction.

The stapler 62 has a configuration for performing so-called "stapling" (i.e., stapling process) to bind the sheet bundle Pb with a staple or staples. More specifically, the stapler 62 includes a stapling-part drive motor 62*d* illustrated in FIG. 7. The stapling-part drive motor 62*d* drives a stapling part 62*a*. A driving force of the stapling-part drive motor 62*d* causes a staple loaded in the stapling part 62*a* to pass through the sheet bundle Pb. Thus, the stapling part 62*a* binds the sheet bundle Pb. Since the stapler 62 has a typical configuration, a detailed description thereof will be omitted unless otherwise required.

As illustrated in FIG. 5, the stapling unit 28 includes a stapling-unit movement assembly 77.

The stapling-unit movement assembly 77 moves the stapling unit 28 in the main scanning direction along the downstream end, in the conveyance direction, of the sheet P or the sheet bundle Pb placed on the internal tray 22.

The stapling-unit movement assembly 77 includes, for example, a base 78, the guide shaft 37, a stapling-unit movement motor 80, and a driving force transmission assembly 81. The driving force transmission assembly 81 transmits a driving force of the stapling-unit movement motor 80 to the base 78 via pulleys 81*a* and 81*b* and a timing belt 81*c*. A stapler shaft 83 provided with a drive transmission gear 83*a* is fixed to a bottom face of a stapling frame 62*b* that holds the components of the stapler 62. The stapler shaft 83 and the drive transmission gear 83*a* are held by the base 78 on which the stapling frame 62*b* is disposed, so as to be rotatable in the forward and reverse directions. The drive transmission gear 83*a* meshes with an output gear 82*a* of a stapler pivot motor 82. The stapler 62 can be rotated in the forward and reverse directions about the stapler shaft 83 on the base 78 by a driving force transmitted from the stapler pivot motor 82 to the stapler shaft 83 via the output gear 82*a* and the drive transmission gear 83*a*.

The crimp binder 27 and the stapling unit 28 are supported by the common guide shaft 37. The driving force transmission assembly 240 and the stapling-unit movement assembly 77 move the crimp binder 27 and the stapling unit 28 in the main scanning direction along the common guide shaft 37. The driving force transmission assembly 240 and the stapling-unit movement assembly 77 can independently move the crimp binder 27 and the stapling unit 28.

The release claw 29 is disposed downstream from the internal tray 22 in the conveyance direction. The position, in the main scanning direction, of the release claw 29 is fixed. The release claw 29 is movable upstream in the conveyance direction (i.e., toward the conveyance roller pair 15) in contact with the downstream end, in the conveyance direction, of the sheet bundle Pb placed on the internal tray 22. The release claw 29 moving upstream in the conveyance direction moves the sheet bundle Pb subjected to the edge binding upstream in the conveyance direction along the internal tray 22. As a result, the sheet bundle Pb subjected to the edge binding is released from the internal tray 22 and enters between rollers of the conveyance roller pair 15. Then, the conveyance roller pair 15 outputs the sheet bundle Pb subjected to the edge binding to the second output tray 30.

The second output tray 30 is disposed on an outer side face of a housing of the post-processing apparatus 3 such that the second output tray 30 can vertically move.

The filler 31 is rotatable above the second output tray 30. An end of the filler 31 contacts the sheet bundle Pb placed on the second output tray 30. The filler 31 detects that the height (thickness) of the sheet bundle Pb stacked on the second output tray 30 reaches a threshold. The filler 31 then outputs the detection result to a controller 100 illustrated in FIG. 7. A detailed description of the controller 100 is deferred. When the filler 31 detects that the height of the sheet bundle Pb reaches the threshold, the controller 100 lowers the second output tray 30 by a given amount.

The post-processing apparatus 3 further includes an end fence 32, a saddle binder 33, a sheet folding blade 34, a hole punch 35, and the third output tray 36. The end fence 32, the saddle binder 33, and the sheet folding blade 34 perform the saddle binding on the sheet bundle Pb constructed of the sheets P that are conveyed through the third conveyance passage Ph3. Among the sheets P supplied from the image forming apparatus 2, the sheet bundle Pb subjected to the saddle binding is output to the third output tray 36.

The end fence 32 aligns the positions, in a direction in which the sheets P are conveyed, of the sheets P that are sequentially conveyed through the third conveyance passage Ph3. The end fence 32 is movable between a binding position where the end fence 32 causes the center of the sheet bundle Pb to face the saddle binder 33 and a folding position where the end fence 32 causes the center of the sheet bundle Pb to face the sheet folding blade 34. The saddle binder 33 binds the center of the sheet bundle Pb aligned by the end fence 32 at the binding position. The sheet folding blade 34 folds, in half, the sheet bundle Pb placed on the end fence 32 at the folding position and causes the conveyance roller pair 18 to sandwich the sheet bundle Pb. The conveyance roller pairs 18 and 19 output the sheet bundle Pb subjected to the saddle binding to the third output tray 36. The hole punch 35 punches a through hole in the sheet bundle Pb that is conveyed by the conveyance roller pairs 15 and 19.

Figure 6A:
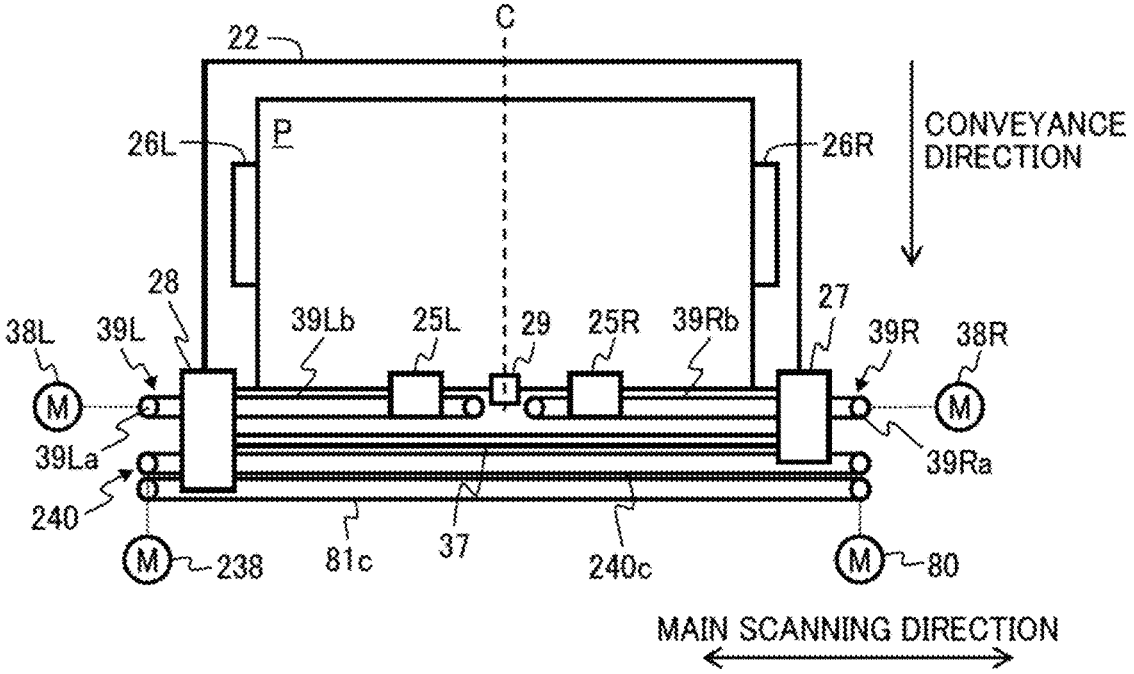
FIGS. 6A and 6B are views of an internal tray of the post-processing apparatus of FIG. 2 in a thickness direction of a sheet.
Figure 6B:
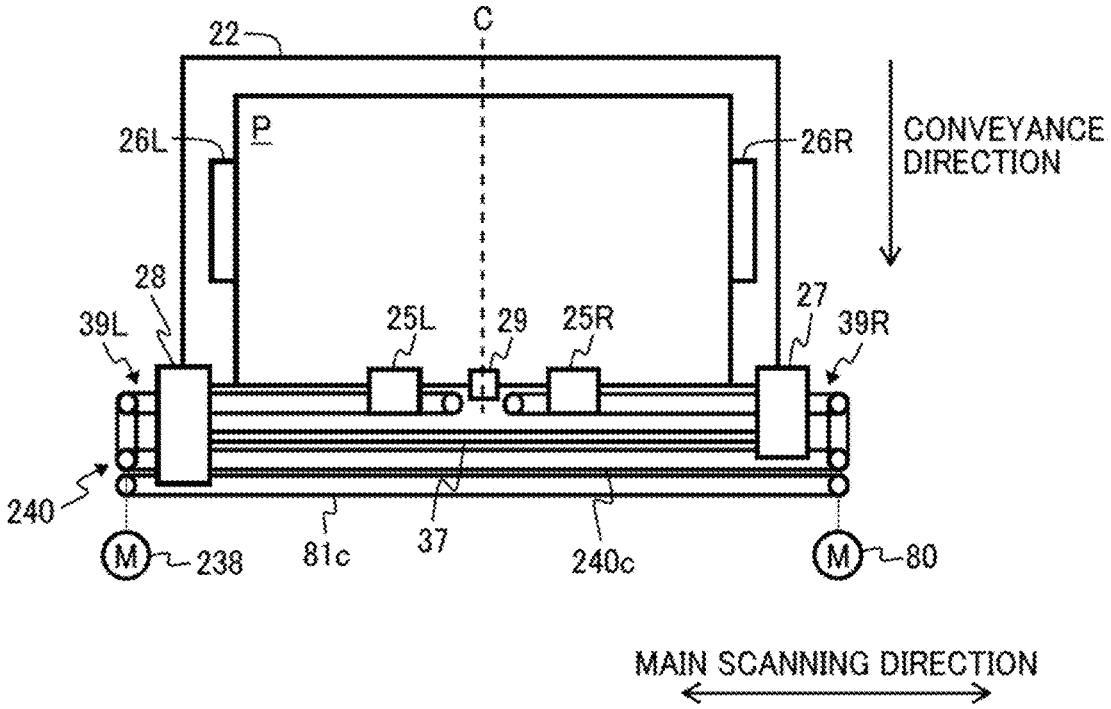

Each of FIGS. 6A and 6B is a view of the internal tray 22 in the thickness direction of the sheet P.

As illustrated in FIGS. 6A and 6B, the post-processing apparatus 3 according to the present embodiment includes a symmetrical pair of end fences 25L and 25R. The end fences 25L and 25R are arranged opposite each other across the release claw 29 in the main scanning direction. In other words, the end fences 25L and 25R arranged opposite each other across a center position C, in the main scanning direction, of the sheet bundle Pb placed on the internal tray 22.

The end fences 25L and 25R are disposed at equal distances from the release claw 29. As described above, the crimp binder 27 and the stapling unit 28 are supported by the guide shaft 37 extending in the main scanning direction at a position downstream from the internal tray 22 in the conveyance direction, such that the crimp binder 27 and the stapling unit 28 can independently move in the main scanning direction. In FIGS. 6A and 6B and subsequent figures, illustration of the stapling unit 28 may be omitted.

Figure 9A:
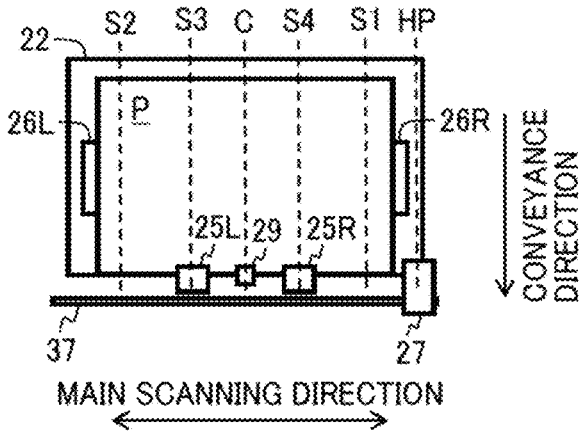
FIGS. 9A to 9F are diagrams illustrating an example of the positions of end fences and the crimp binder of FIG. 3 during the binding process of FIG. 8.
Figure 9B:
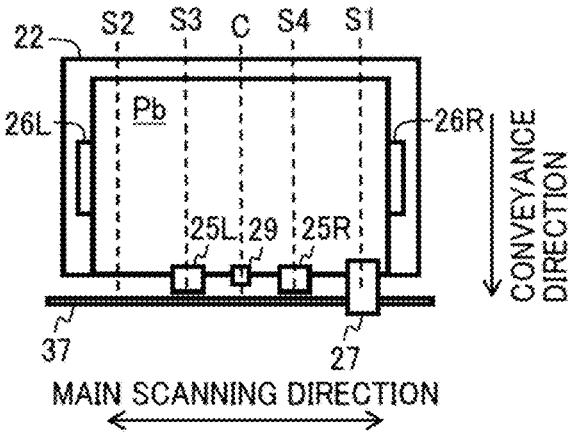
Figure 9C:
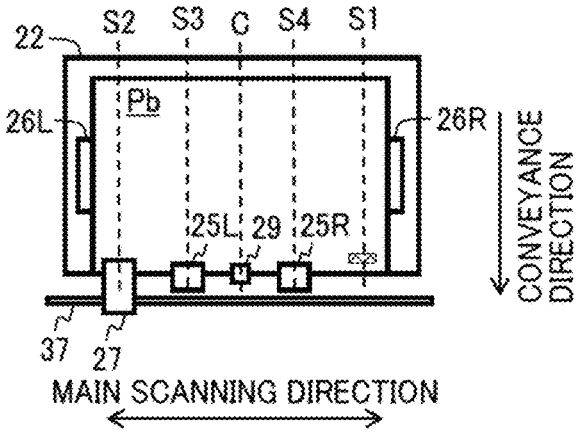
Figure 9D:
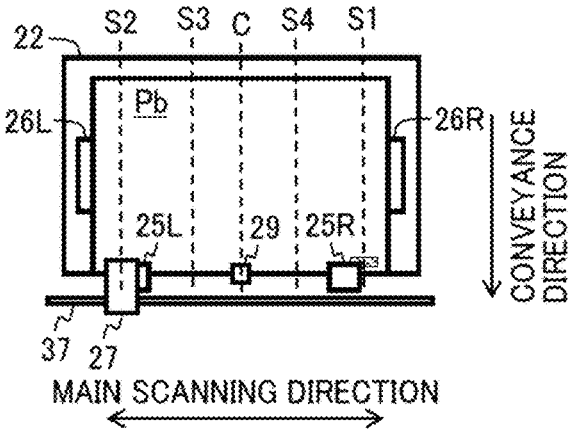
Figure 9E:
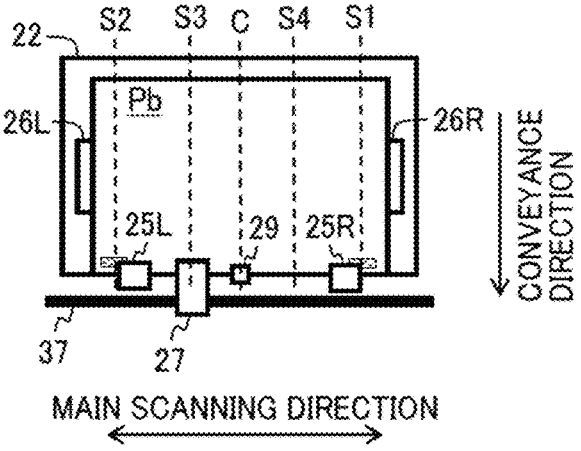
Figure 9F:
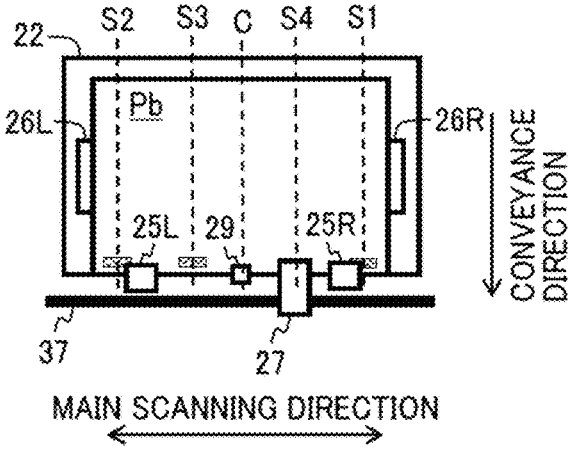

The end fences 25L and 25R according to the present embodiment move between respective proximate positions illustrated in FIGS. 9A to 9C and respective distant positions illustrated in FIGS. 9D to 9F. The interval between the end fences 25L and 25R in the main scanning direction is greater at the respective distant positions than at the respective proximate positions. In other words, the distant position is farther from the center position C than the proximate position. Note that the distance from the center position C to the end fence 25L at the proximate position is equal to the distance from the center position C to the end fence 25R at the proximate position. Similarly, the distance from the center position C to the end fence 25L at the distant position is equal to the distance from the center position C to the end fence 25R at the distant position. Thus, the end fences 25L and 25R move in the main scanning direction while maintaining the same distance from the center position C. In other words, the interval between the end fences 25L and 25R in the main scanning direction increases or decreases. The positions to which the end fences 25L and 25R can move are not limited to the positions illustrated in FIGS. 9A to 9F.

On the other hand, the crimp binder 27 according to the present embodiment moves between a standby position HP illustrated in FIG. 9A and positions where the crimp binder 27 faces binding positions S1 to S4 as illustrated in FIGS. 9B to 9F. The standby position HP is away in one of the main scanning directions from the sheet P placed on the internal tray 22. For example, in FIG. 9A, the standby position HP is distanced to the right of the sheet P in the main scanning direction. The binding positions S1 to S4 are positions on the sheet bundle Pb placed on the internal tray 22. However, the specific positions of the binding positions S1 to S4 are not limited to the positions illustrated in FIGS. 9A and 9F. The binding positions S1 to S4 may be positions in the main scanning direction at the downstream end, in the conveyance direction, of the sheet bundle Pb.

As an example, as illustrated in FIG. 6A, the end fences 25L and 25R are independently moved in the main scanning direction by a driving force transmitted from end-fence motors 38L and 38R serving as first driving sources through a driving force transmission assemblies 39L and 39R. The driving force transmission assembly 39L includes, for example, pulleys 39La and a timing belt 39Lb. Similarly, the driving force transmission assembly 39R includes, for example, pulleys 39Ra and a timing belt 39Rb. The position, in the main scanning direction, of the end fence 25L is detected by a sensor disposed within the moving range of the end fence 25L, a rotary encoder 38Le (see FIG. 7) of the end-fence motor 38L, or a combination thereof. Similarly, the position of the end fence 25R in the main scanning direction is detected by a sensor disposed within the moving range of the end fence 25R, a rotary encoder 38Re (see FIG. 7) of the end-fence motor 38R, or a combination thereof. The readings indicating the detected positions of the end fences 25L and 25R are provided to the controller 100.

As described above, the crimp binder 27 is moved in the main scanning direction by the driving force that is transmitted from the crimper movement motor 238 by the driving force transmission assembly 240 including the pulleys 240*a* and 240*b* and the timing belt 240*c*. On the other hand, the stapling unit 28 is moved in the main scanning direction by the driving force that is transmitted from the stapling-unit movement motor 80 by the driving force transmission assembly 81 including the pulleys 81*a* and 81*b* and the timing belt 81*c*. The positions, in the main scanning direction, of the crimp binder 27 and the stapling unit 28 are detected by a rotary encoder 238*e* (see FIG. 7) of the crimper movement motor 238 and a rotary encoder 80*e* (see FIG. 7) of the stapling-unit movement motor 80, respectively. Readings indicating the detected positions of the crimp binder 27 and the stapling unit 28 are provided to the controller 100.

As another example, as illustrated in FIG. 6B, the driving force transmission assemblies 39L and 39R and the driving force transmission assembly 240 may be coupled to each other. The end fences 25L and 25R and the crimp binder 27 may be moved in the main scanning direction in conjunction with each other by, for example, the driving force transmitted from the crimper movement motor 238 as a common driving source through the driving force transmission assemblies 39L and 39R and the driving force transmission assembly 240. In this case, the end-fence motors 38L and 38R illustrated in FIG. 6A may be omitted.

Figure 7:
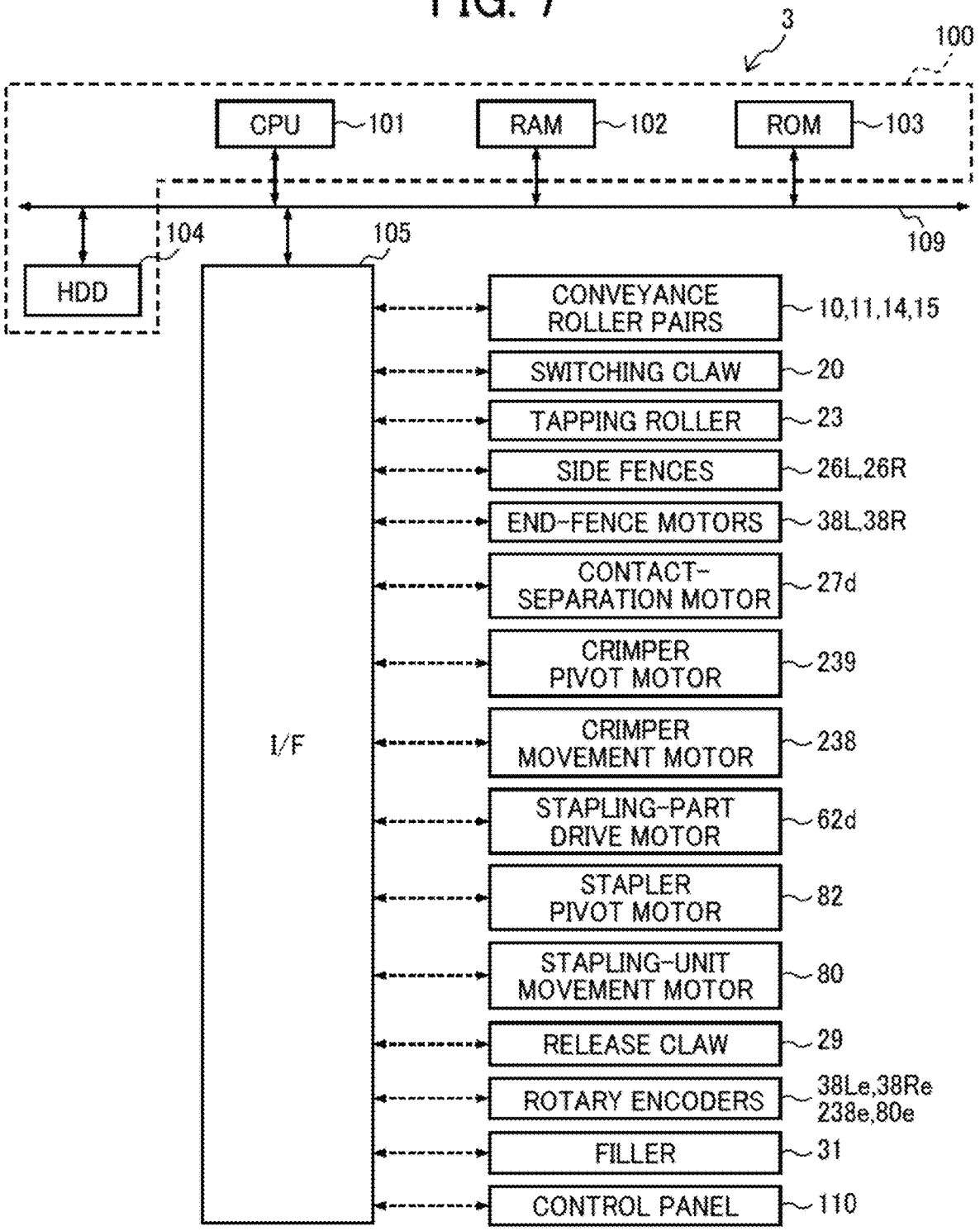
FIG. 7 is a block diagram illustrating a hardware configuration of the post-processing apparatus of FIG. 2 to control the post-processing apparatus.

FIG. 7 is a block diagram illustrating a hardware configuration of the post-processing apparatus 3.

As illustrated in FIG. 7, the post-processing apparatus 3 includes a central processing unit (CPU) 101, a random access memory (RAM) 102, a read only memory (ROM) 103, a hard disk drive (HDD) 104, and an interface (LF) 105. The CPU 101, the RAM 102, the ROM 103, the HDD 104, and the I/F 105 are connected to each other via a common bus 109. The CPU 101 is an arithmetic unit and controls the overall operation of the post-processing apparatus 3. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an operating system (OS), various control programs, and application programs.

By an arithmetic function of the CPU 101, the post-processing apparatus 3 processes, for example, a control program stored in the ROM 103 and an information processing program (application program) loaded into the RAM 102 from a storage medium such as the HDD 104. Such processing configures a software controller including various functional modules of the post-processing apparatus 3. The software controller that is thus configured cooperates with hardware resources of the post-processing apparatus 3 to construct functional blocks that implement functions of the post-processing apparatus 3. In other words, the CPU 101, the RAM 102, the ROM 103, and the HDD 104 construct the controller 100 that controls the operation of the post-processing apparatus 3.

The I/F 105 is an interface that connects the conveyance roller pairs 10, 11, 14, and the switching claw 20, the tapping roller 23, the side fences 26L and 26R, the end-fence motors 38L and 38R, the contact-separation motor 27*d*, the crimper pivot motor 239, the crimper movement motor 238, the stapling-part drive motor 62*d*, the stapler pivot motor 82, the stapling-unit movement motor 80, the release claw 29, the rotary encoders 38Le, 38Re, 238*e*, and 80*e*, the filler 31, and a control panel 110 to the common bus 109.

The controller 100 controls, via the I/F 105, the operations of the conveyance roller pairs 10, 11, 14, and 15, the switching claw 20, the tapping roller 23, the side fences 26L and 26R, the end-fence motors 38L and 38R, the contact-separation motor 27*d*, the crimper pivot motor 239, the crimper movement motor 238, the stapling-part drive motor 62*d*, the stapler pivot motor 82, the stapling-unit movement motor 80, and the release claw 29. On the other hand, the controller 100 acquires detection results from the rotary encoders 38Le, 38Re, 238*e*, and 80*e* and the filler 31. Although FIG. 7 illustrates the components related to the stapling unit 28 and the crimp binder 27 that executes the edge binding, the components related to the saddle binder 33 that executes the saddle binding are controlled by the controller 100 like the components related to the stapling unit 28 and the crimp binder 27 that executes the edge binding.

As illustrated in FIG. 1, the image forming apparatus 2 includes the control panel 110. The control panel 110 includes an operation unit that receives instructions from a user and a display serving as a notifier that notifies the user of information. The operation unit includes, for example, hard keys and a touch panel superimposed on the display. The control panel 110 acquires information from the operator through the operation unit and provides information to the operator through the display. Note that a specific example of the notifier is not limited to the display and may be a light emitting diode (LED) lamp or a speaker. The post-processing apparatus 3 may include the control panel 110 like the control panel 110 described above.

Figure 8:
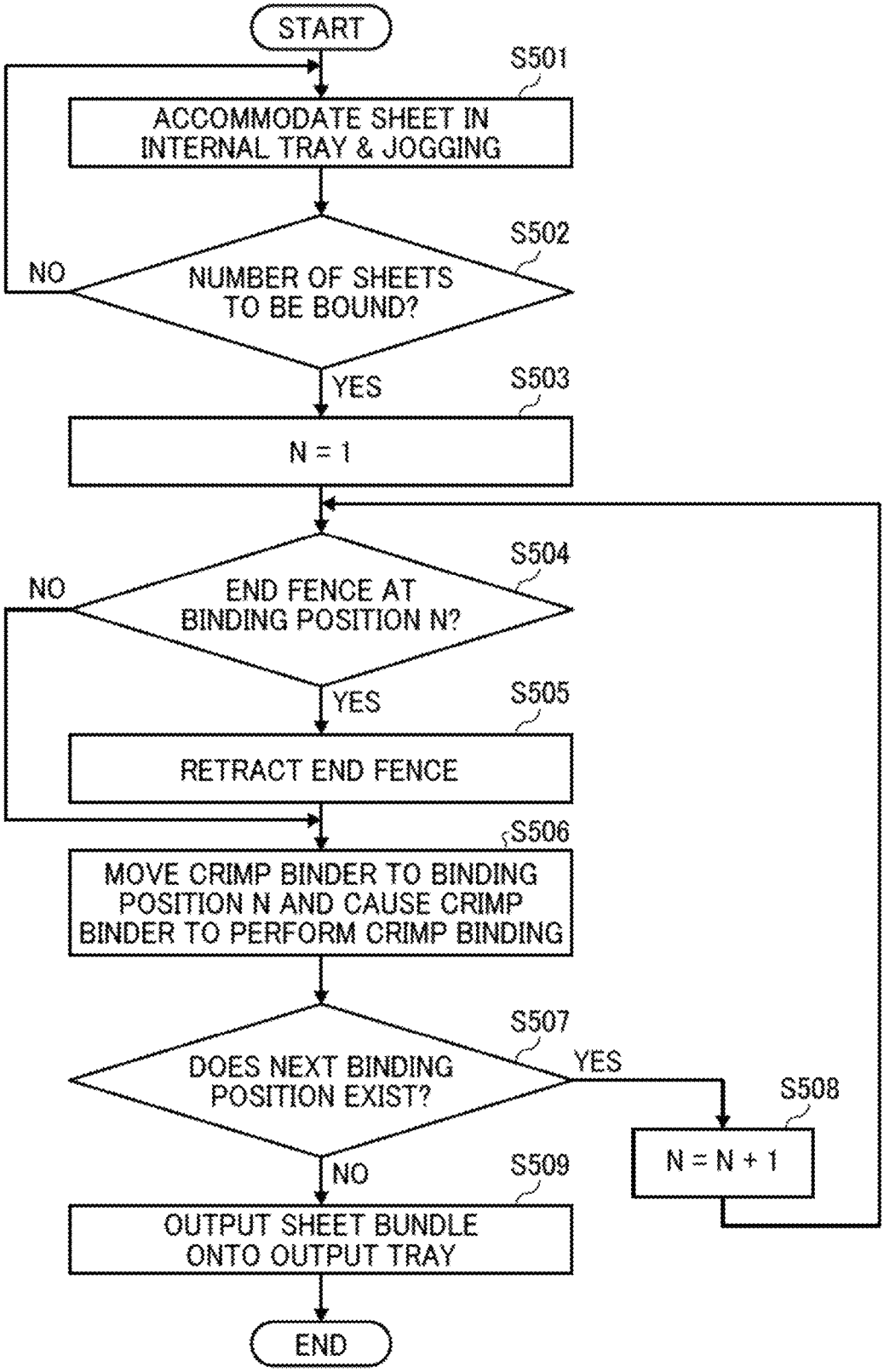
FIG. 8 is a flowchart of a binding process performed by the crimp binder of FIG. 3.

FIG. 8 is a flowchart of a binding process.

FIGS. 9A to 9F are diagrams illustrating an example of the positions of the end fences 25L and 25R and the crimp binder 27 during the binding process.

For example, the controller 100 starts the binding process illustrated in FIG. 8 when the controller 100 acquires an instruction to execute the binding process from the image forming apparatus 2. In the following description, the instruction to execute the binding process may be referred to as a "binding command." The binding command includes, for example, the binding position on the sheet bundle Pb in the main scanning direction, the number of binding positions on the sheet bundle Pb, and the number of sheets P of the sheet bundle Pb. In the following description, the number of sheets P of the sheet bundle Pb may be referred to as the "number of sheets to be bound." As illustrated in FIG. 9A, at the start of the binding process, the end fences 25L and 25R are at the respective proximate positions while and the crimp binder 27 is at the standby position HP.

In step S501, the controller 100 rotates the conveyance roller pairs 10, 11, 14, and 15 to accommodate, in the internal tray 22, the sheet P on which an image is formed by the image forming apparatus 2. The controller 100 also moves the side fences 26L and 26R to align the position, in the main scanning direction, of the sheet P or the sheet bundle Pb placed on the internal tray 22. In short, the controller 100 performs so-called jogging.

Subsequently, in step S502, the controller 100 determines whether the number of sheets P accommodated in the internal tray 22 has reached the number of sheets to be bound, which is instructed by the binding command.

When the controller 100 determines that the number of sheets P accommodated in the internal tray 22 has not reached the number of sheets to be bound (NO in step S502), the controller 100 executes the operation of step S501 again. On the other hand, when the controller 100 determines that the number of sheets P accommodated in the internal tray 22 has reached the number of sheets to be bound (YES in step S502), in step S503, the controller 100 initializes a variable N stored in the HDD 104. In other words, in step S503, the controller 100 sets the variable N to 1.

Subsequently, in step S504, the controller 100 determines whether the end fence 25L or 25R overlaps a binding position N when the internal tray 22 is viewed in the thickness direction. In the present embodiment, as illustrated in FIGS. 9A to 9F, the binding positions S1, S2, S3, and S4 are crimped and bound. The order in which the binding positions S1 to S4 are crimped and bound is not particularly limited. However, the binding position that overlaps neither the end fence 25L nor 25R is preferably crimped and bound first.

When the controller 100 determines that neither the end fence 25L nor 25R overlaps the binding position S1 (NO in step S504), in step S506, the controller 100 causes the crimp binder 27 to crimp and bind the binding position S1 without executing the operation of step S505 (i.e., without moving the end fence 25L or 25R). In other words, as illustrated in FIG. 9B the controller 100 drives the crimper movement motor 238 to move the crimp binder 27 to the position where the crimp binder 27 faces the binding position S1 and causes the crimp binder 27 to sandwich the binding position S1 on the sheet bundle Pb between the upper crimping teeth 27*a* and the lower crimping teeth 27*b* to press and deform the binding position S1.

Subsequently, in step S507 the controller 100 determines whether any binding position that is yet to be crimped and bound exists.

When the controller 100 determines that a binding position that is yet to be crimped and bound exists (YES in step S507), in step S508, the controller 100 increases the variable N by 1. Then, the controller 100 performs the operation of step S504 again.

Specifically, in step S504, the controller 100 determines whether the end fence 25L or 25R overlaps the binding position S2.

When the controller 100 determines that neither the end fence 25L nor 25R overlaps the binding position S2 (NO in step S504), in step S506, the controller 100 causes the crimp binder 27 to crimp and bind the binding position S2 that overlaps neither the end fence 25L nor 25R as illustrated in FIG. 9C.

Thereafter, in step S507, the controller 100 determines again whether any binding position that is yet to be crimped and bound exists.

When the controller 100 determines that a binding position that is yet to be crimped and bound exists (YES in step S507), in step S508, the controller 100 increases the variable N by 1. Then, the controller 100 performs the operation of step S504 again.

Specifically, in step S504, the controller 100 determines whether the end fence 25L or 25R overlaps the binding position S3.

When the controller 100 determines that the end fence 25L or 25R overlaps the binding position S3 (YES in step S504), in step S505, the controller 100 drives the end-fence motors 38L and 38R to move the end fences 25L and 25R to the respective distant positions as illustrated in FIG. 9D. In other words, in step S505, the controller 100 moves the end fences 25L and 25R in the main scanning direction to respective positions away from the binding position S3.

After moving the end fences 25L and 25R, in step S506, the controller 100 causes the crimp binder 27 to crimp and bind the binding position S3 as illustrated in FIG. 9E.

Thereafter, in step S507, the controller 100 determines again whether any binding position that is yet to be crimped and bound exists.

When the controller 100 determines that a binding position that is yet to be crimped and bound exists (YES in step S507), in step S508, the controller 100 increases the variable N by 1. Then, the controller 100 performs the operation of step S504 again.

Specifically, in step S504, the controller 100 determines whether the end fence 25L or 25R overlaps the binding position S4.

When the controller 100 determines that neither the end fence 25L nor 25R overlaps the binding position S4 (NO in step S504), in step S506, the controller 100 causes the crimp binder 27 to crimp and bind the binding position S4 that overlaps neither the end fence 25L nor 25R as illustrated in FIG. 9F.

When the controller 100 determines that all the binding positions S1 to S4 are crimped and bound (NO in step S507), in step S509, the controller 100 outputs the sheet bundle Pb thus crimped and bound to the second output tray 30. More specifically, the controller 100 moves the release claw 29 upstream in the conveyance direction so that the rollers of the conveyance roller pair 15 sandwich the sheet bundle Pb. The controller 100 then rotates the conveyance roller pair 15 to output the sheet bundle Pb to the second output tray 30. The controller 100 also moves the end fences 25L and 25R and the crimp binder 27 to the respective initial positions illustrated in FIG. 9A.

The number of binding positions is not limited to the number of binding positions illustrated in FIGS. 9A to 9F. The respective initial positions of the end fences 25L and 25R are not limited to the respective proximate positions.

FIGS. 10A to 10E are diagrams illustrating another example of the positions of the end fences 25L and 25R and the crimp binder 27 during the binding process.

In FIGS. 10A to 10E, six binding positions S1 to S6 are crimped and bound. The end fences 25L and 25R are at the respective distant positions at the start of the binding process.

Figure 10A:
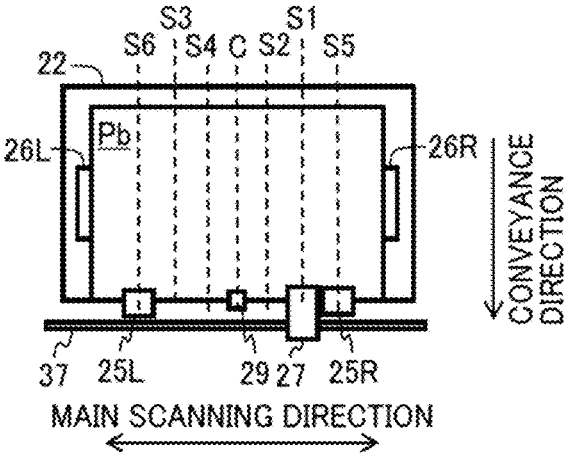
FIGS. 10A to 10E are diagrams illustrating another example of the positions of end fences and the crimp binder of FIG. 3 during the binding process of FIG. 8.
Figure 10B:
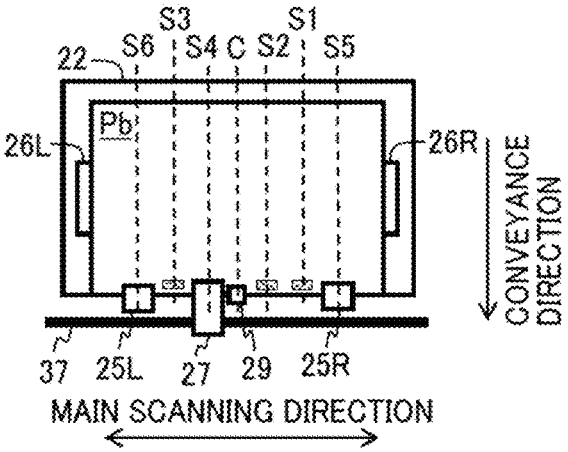
Figure 10C:
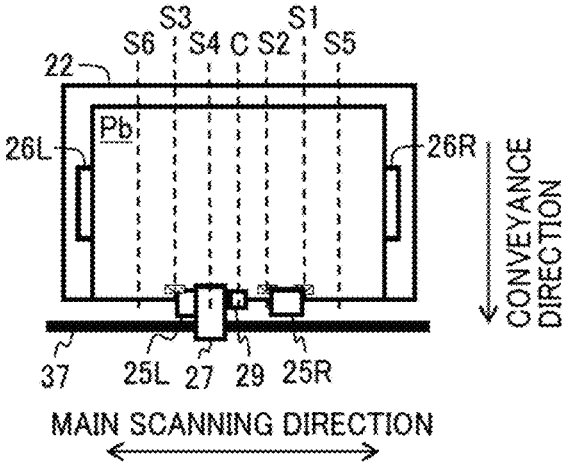
Figure 10D:
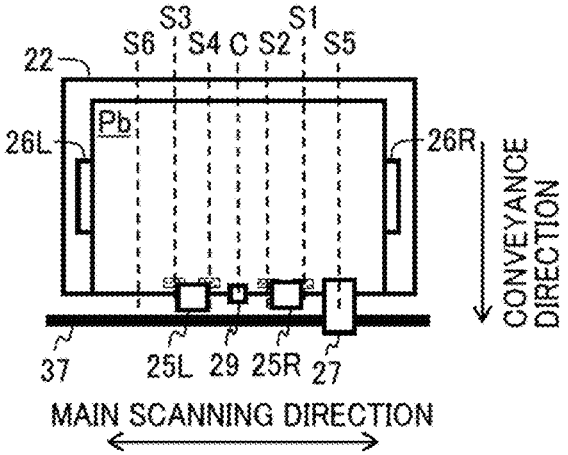
Figure 10E:
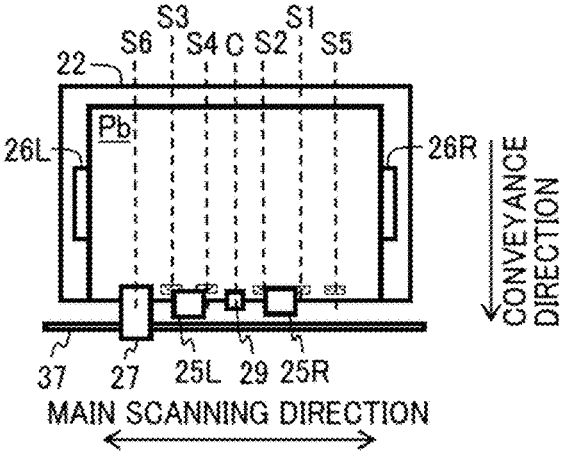

First, as illustrated in FIGS. 10A and 10B, the controller 100 causes the crimp binder 27 to sequentially crimp and bind the binding positions S1 to S4 that overlap neither the end fence 25L nor 25R. The controller 100 then moves the end fences 25L and 25R to the respective proximate positions away from the binding positions S5 and S6 as illustrated in FIG. 10C. The controller 100 then causes the crimp binder 27 to sequentially crimp and bind the binding positions S5 and S6 that overlap neither the end fence 25L nor 25R as illustrated in FIGS. 10D and 10E.

Preferably, the binding positions are symmetrical with respect to the center position C as illustrated in FIGS. 9A to 10E. The controller 100 retracts the end fences 25L and 25R preferably after causing the crimp binder 27 to crimp and bind at least one binding position on each side of the center position C in the main scanning direction among the plurality of binding positions. The intervals between the plurality of binding positions in the main scanning direction is preferably changed depending on, for example, the number of binding positions or the size of the sheet P in the main scanning direction.

Figure 11A:
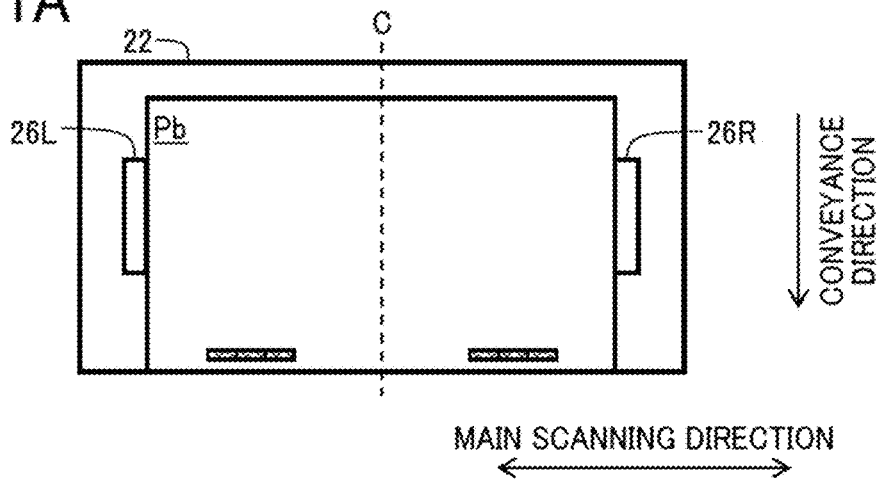
FIGS. 11A to 11C are diagrams illustrating variations in intervals between binding positions in a main scanning direction.
Figure 11B:
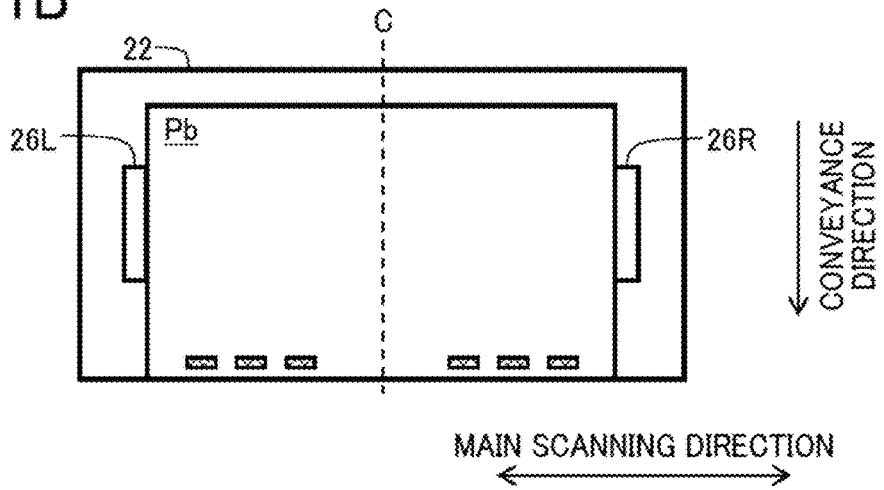
Figure 11C:
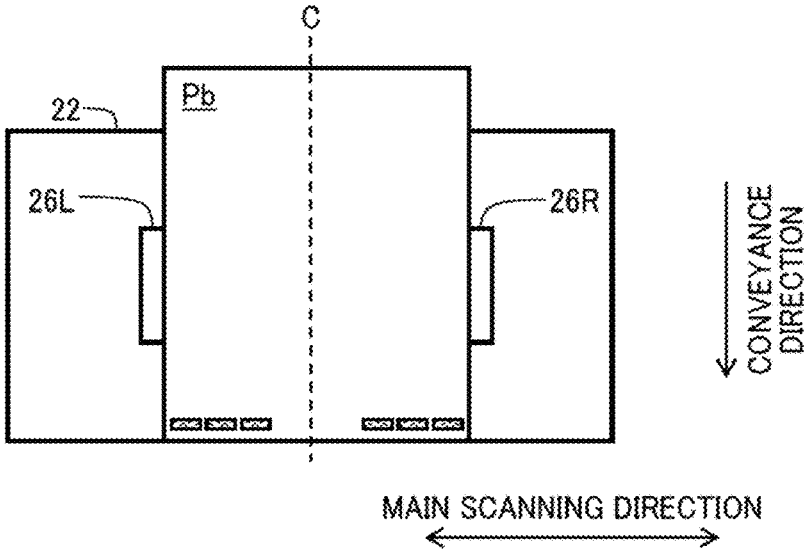

FIGS. 11A to 11C are diagrams illustrating variations in the intervals between the plurality of binding positions in the main scanning direction.

Figure 12:
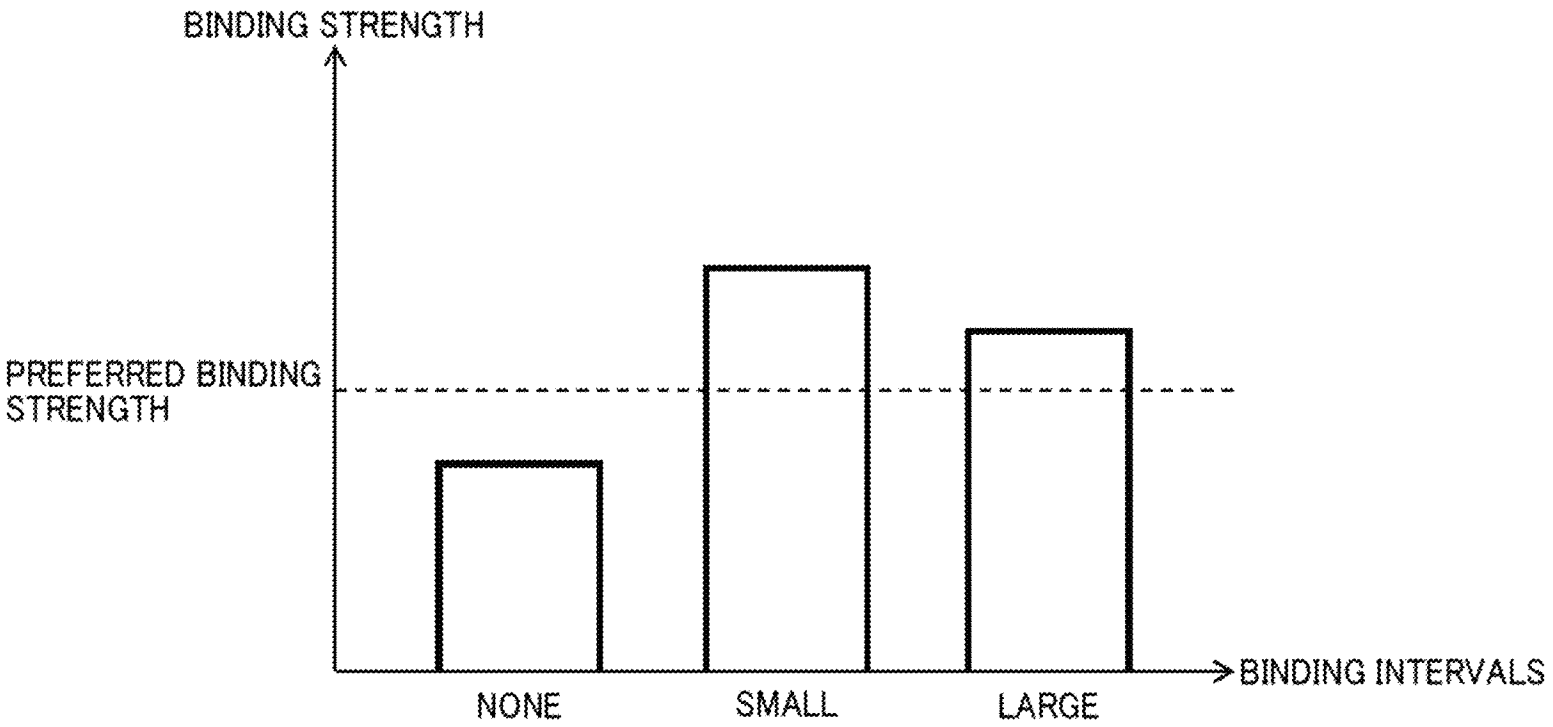
FIG. 12 is a graph illustrating a relation between a binding strength and intervals between binding positions.

FIG. 12 is a graph illustrating a relation between the binding strength and the intervals between the binding positions.

As illustrated in FIG. 11A, when the intervals are 0 mm between the adjacent binding positions in the main scanning direction, the binding strength is lower than a preferred binding strength as indicated by "none" in the axis representing the binding intervals in FIG. 12. In other words, the plurality of binding positions are preferably arranged at given intervals in the main scanning direction.

Even when the sheets P in the same size are conveyed, the widths of the sheets P in the main scanning direction vary between a case where the sheet P is conveyed with a longitudinal direction of the sheet P in the main scanning direction (i.e., long edge feed [LEF] illustrated in FIG. 11B) and a case where the sheet P is conveyed with a short direction of the sheet P in the main scanning direction (i.e., short edge feed [SEF] illustrated in FIG. 11C). When the sheets P in different sizes (for example, A4 and B5) are conveyed, the widths of the sheets P in the main scanning direction vary. To handle such a situation, the controller 100 may change the intervals between the plurality of binding positions in the main scanning direction depending on the width of the sheet P in the main scanning direction.

Now, a description is given of two example ways to change the arrangement of the binding positions from the arrangement illustrated in FIG. 11B to the arrangement illustrated in FIG. 11C.

As a first example, the intervals between the binding positions are narrowed with the binding positions closest to the center position C fixed. As a second example, the binding positions are shifted to the center position C while maintaining the intervals between the binding positions.

As illustrated in FIG. 12, when the intervals between the plurality of binding positions in the main scanning direction are equal to or greater than 5 mm as indicated by "large" in the axis representing the binding intervals in FIG. 12, the binding strength decreases compared to a case where the intervals are less than 5 mm as indicated by "small" in the axis representing the binding intervals in FIG. 12. For this reason, the intervals between the plurality of binding positions in the main scanning direction are preferably greater than 0 mm and smaller than 5 mm.

Now, a description is given of some or all of the advantages according to the embodiment described above, the enumeration of which is not exhaustive or limiting.

According to the embodiment described above, when the end fences 25L and 25R, which are movable in the main scanning direction, overlap the binding positions, the crimp binder 27 crimps and binds the binding positions after the end fences 25L and 25R are retracted. Thus, the crimp binder 27 crimps and binds selected positions in the main scanning direction on the sheet bundle Pb. Since a preferred number of binding positions secured, a preferred binding strength is maintained for the sheet bundle Pb.

According to the embodiment described above, the binding strength is increased as illustrated in FIG. 12 by the crimp binding at a plurality of binding positions at given intervals in the main scanning direction. Thus, as compared with a case where the intervals between the binding positions are 0, a preferred binding strength is obtained for the sheet bundle Pb even when the number of binding positions is reduced.

According to the embodiment described above, by changing the intervals between the binding positions in the main scanning direction depending on the width of the sheet P in the main scanning direction, a preferred number of binding positions is determined for the sheet bundles Pb in various sizes. As a result, a preferred binding strength is obtained for the sheet bundle Pb regardless of the size of the sheet bundle Pb.

According to the embodiment described above, before the end fences 25L and 25R are moved to positions where the end fences 25L and 25R do not overlap the binding positions, the crimp binder 27 crimps and binds at least one binding position, to prevent the misalignment of the sheet brindle Pb that may be caused by the movement of the end fences 25L and 25R.

In the case where the end fences 25L and 25R and the crimp binder 27 are respectively driven by the end-fence motors 38L and 38R and the crimper movement motor 238 that are separate from each other as illustrated in FIG. 6A, the positions and timings of movement of the end fences 25L and 25R and the crimp binder 27 are individually optimized. On the other hand, in the case where the end fences 25L and 25R and the crimp binder 27 are driven by the common crimper movement motor 238 as illustrated in FIG. 6B, cost reduction and space saving of the post-processing apparatus 3 are achieved.

Now, a description is given of a first modification of the embodiment described above.

Figure 13A:
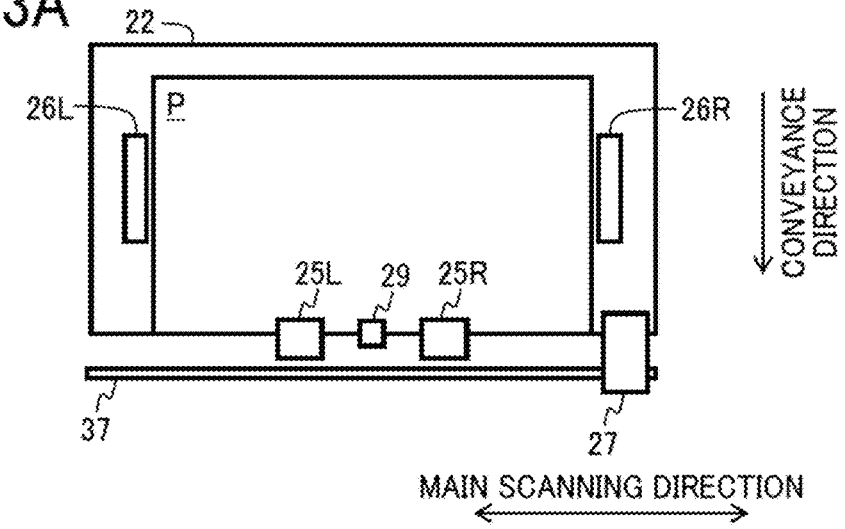
FIGS. 13A to 13C are diagrams illustrating the positions of side fences during a binding process according to a first modification.
Figure 13B:
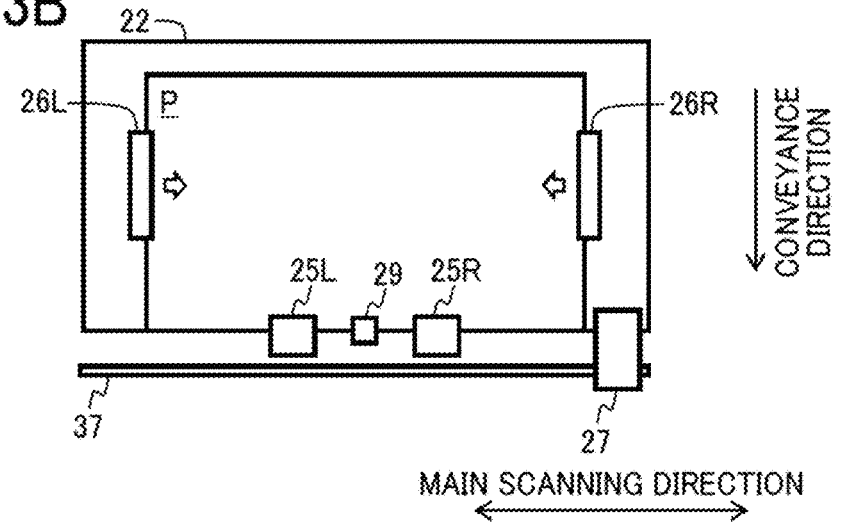
Figure 13C:
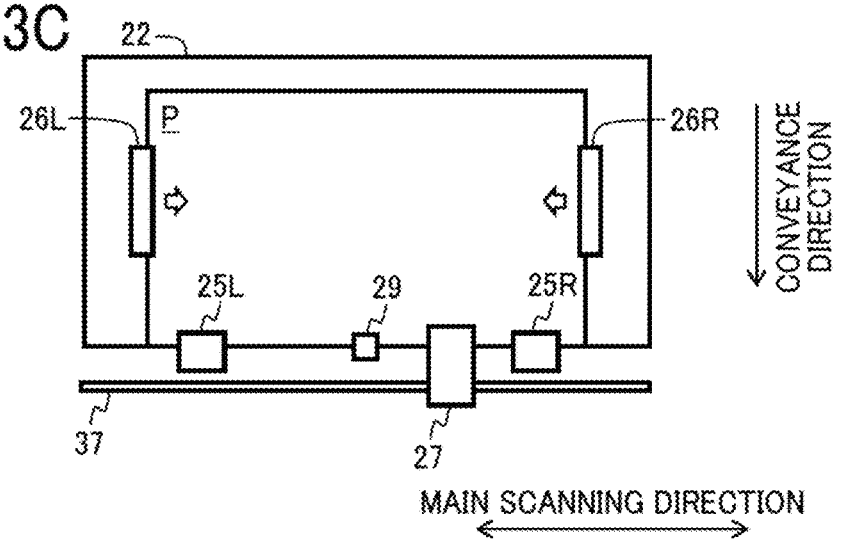

Specifically, referring now to FIGS. 13A to 13C, a description is given of an operation of the post-processing apparatus 3 according to the first modification.

FIGS. 13A to 13C are diagrams illustrating the positions of the side fences 26L and 26R during a binding process according to the first modification.

Note that detailed descriptions will be omitted of common features of the embodiment described above and the present modification. The following description concentrates on the differences between the embodiment described above and the present modification.

According to the first modification, the controller 100 moves the side fences 26L and 26R so that the interval between the side fences 26L and 26R is greater than the width of the Sheet P in the main scanning direction as illustrated in FIG. 13A when the sheet P is accommodated in the internal tray 22. Thus, the sheet P smoothly enters the internal tray 22. On the other hand, according to the first modification, the controller 100 moves the side fences 26L and 26R so that the interval between the side fences 26L and 26R is smaller than the width of the sheet P in the main scanning direction as illustrated in FIG. 13B, before retracting the end fences 25L and 25R in step S505 of FIG. 8 (in other words, before moving the end fences 25L and 25R in the main scanning direction). In other words, according to the first modification, the controller 100 retracts the end fences 25L and 25R in step S505 of FIG. 8 while the interval between the side fences 26L and 26R is smaller than the width of the sheet P in the main scanning direction as illustrated in FIG. 13C.

According to the first modification, the controller 100 moves the end fences 25L and in the main scanning direction while the sheet bundle Pb is fixed to the internal tray 22 by the side fences 26L and 26R, to prevent the position of the sheet bundle Pb from being shifted due to the movement of the end fences 25L and 25R.

Since a desired position is crimped and bound by the crimp binder 27, a preferred binding strength is obtained.

Now, a description is given of a second modification of the embodiment described above.

Figure 14A:
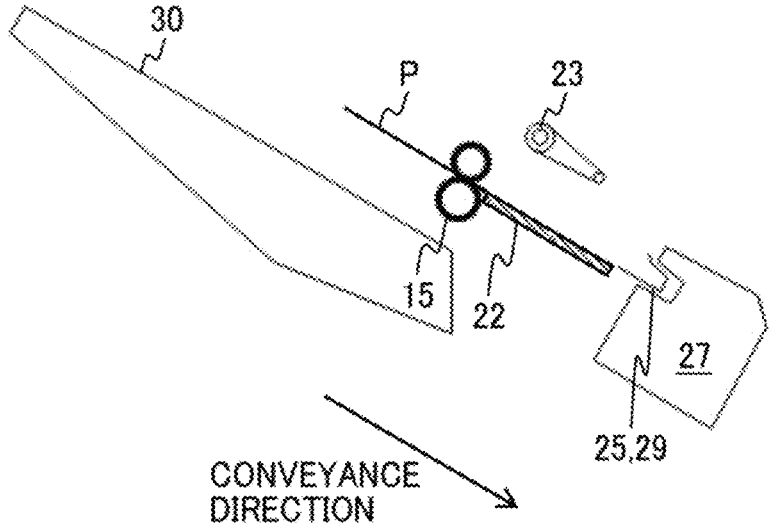
FIGS. 14A and 14B are diagrams illustrating the positions of a tapping roller during a binding process according to a second modification.
Figure 14B:
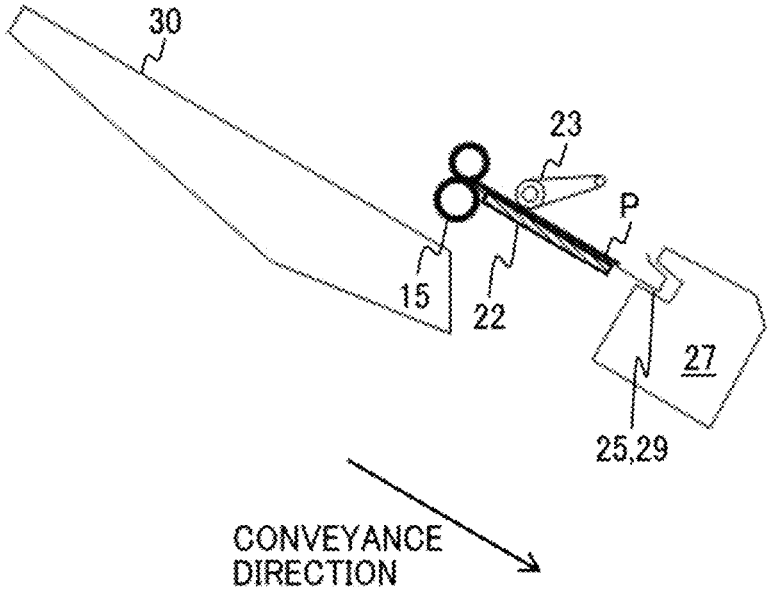

Specifically, referring now to FIGS. 14A and 14B, a description is given of an operation of the post-processing apparatus 3 according to the second modification. FIGS. 14A and 14B are diagrams illustrating the positions of the tapping roller 23 during a binding process according to the second modification.

Note that detailed descriptions will be omitted of common features of the embodiment described above and the present modification. The following description concentrates on the differences between the embodiment described above and the present modification.

According to the second modification, the controller 100 retracts the tapping roller 23 above the internal tray 22 as illustrated in FIG. 14A when the sheet P sandwiched between the rollers of the conveyance roller pair 15 enters the internal tray 22. According to the second modification, the controller 100 brings the tapping roller 23 into contact with the upper face of the sheet P that has entered the internal tray 22, to separate the sheet P from the conveyance roller pair 15. Thus, the sheet P conveyed by the conveyance roller pair 15 is smoothly accommodated in the internal tray 22.

According to the second modification, the controller 100 brings the tapping roller 23 into contact with the uppermost sheet P placed on the internal tray 22 (in other words, the uppermost sheet P of the sheet bundle Pb) as illustrated in FIG. 14B, before retracting the end fences 25L and 25R in step S505 of FIG. 8. In other words, according to the second modification, the controller 100 retracts the end fences 25L and 25R in step S505 of FIG. 8 while the tapping roller 23 is in contact with the uppermost sheet P placed on the internal tray 22.

According to the second modification, the controller 100 moves the end fences 25L and 25R in the main scanning direction while the sheet bundle Pb is fixed to the internal tray 22 by the tapping roller 23, to prevent the position of the sheet bundle Pb from being shifted due to the movement of the end fences 25L and 25R. Since a desired position is crimped and bound by the crimp binder 27, a preferred binding strength is obtained.

Now, a description is given of third and fourth modifications of the embodiment described above.

Figure 15A:
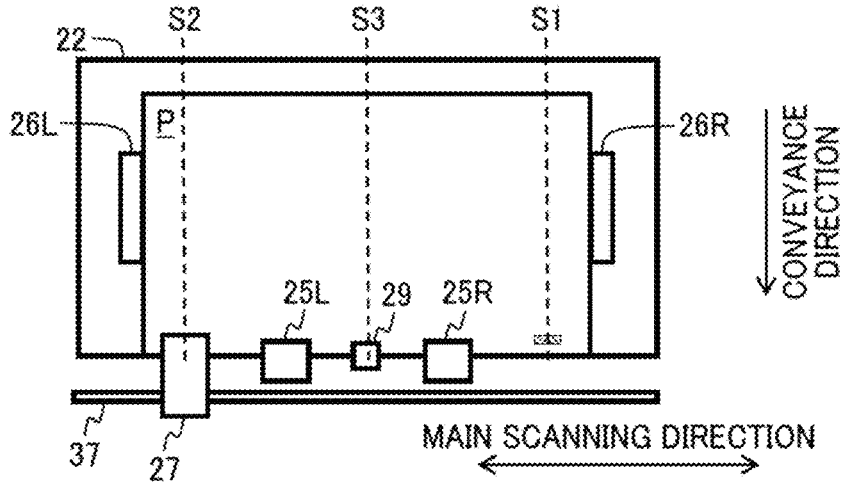
FIGS. 15A to 15C are diagrams illustrating the positions of side fences during a binding process according to a third modification.

Specifically, referring now to FIGS. 15A to 16C, a description is given of operations of the post-processing apparatus 3 according to the third and fourth modifications. FIGS. 15A to 15C are diagrams illustrating the positions of the side fences 26L and 26R during a binding process according to the third modification.

Figure 16A:
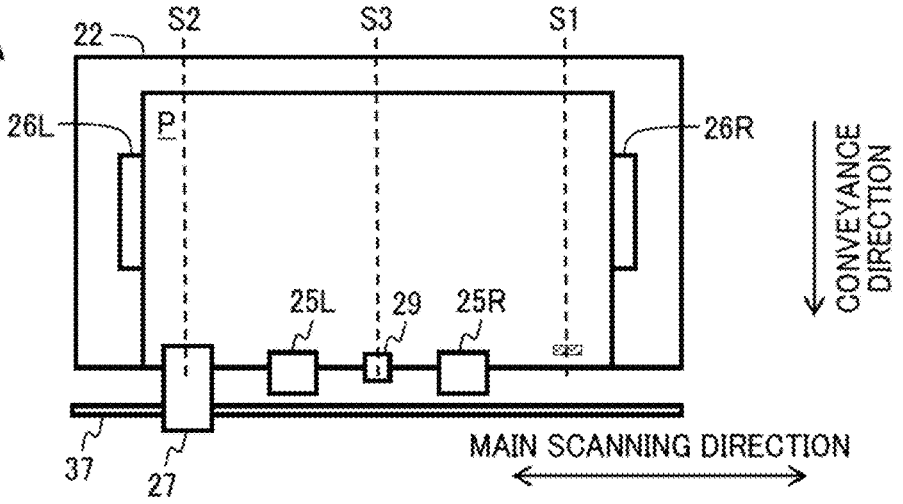
FIGS. 16A to 16C are diagrams illustrating the positions of an internal tray and side fences during a binding process according to a fourth modification.
Figure 16B:
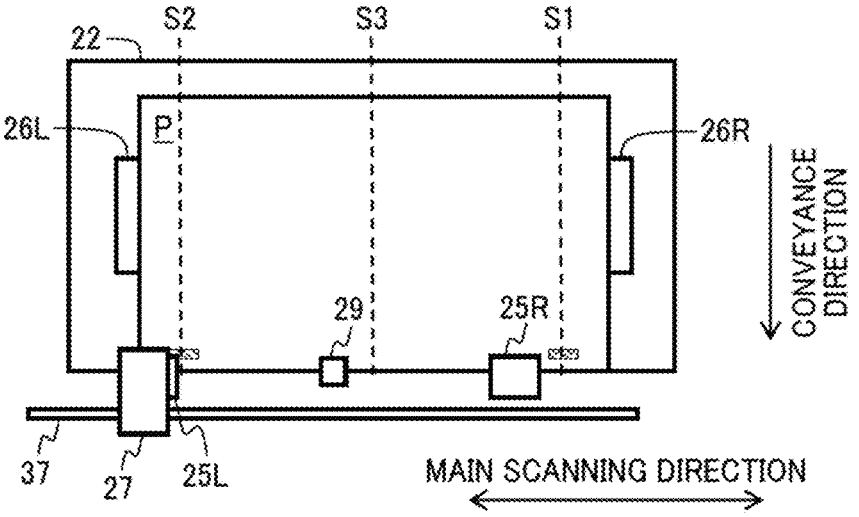
Figure 16C:
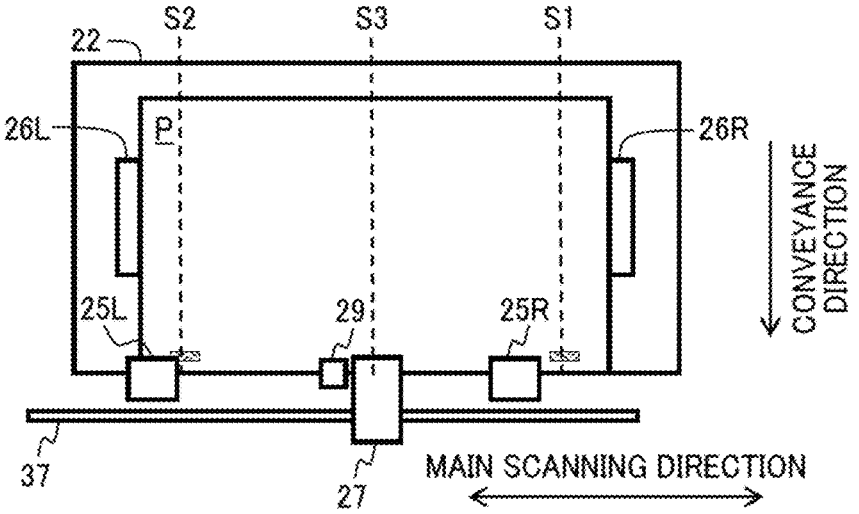

FIGS. 16A to 16C are diagrams illustrating the positions of the internal tray 22 and the side fences 26L and 26R during a binding process according to the fourth modification.

Note that detailed descriptions will be omitted of common features of the embodiment described above and the present modifications. The following description concentrates on the differences between the embodiment described above and the present modifications.

Figure 15B:
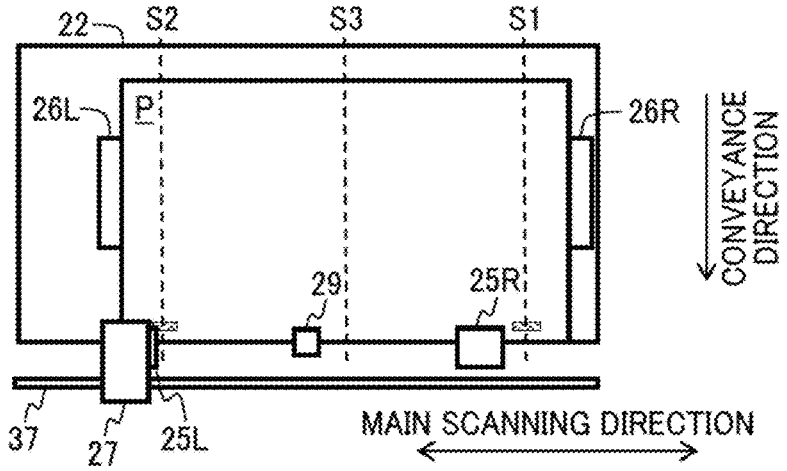

According to the third and fourth modifications, in step S504 of FIG. 8, the controller 100 determines whether the end fence 25L or 25R overlaps the binding position N when the internal tray 22 is viewed in the thickness direction and whether the release claw 29 overlaps the binding position N when the internal tray 22 is viewed in the thickness direction. According to the third and fourth modifications, when the controller 100 determines that the release claw 29 overlaps the binding position S3 as illustrated in FIGS. 15A and 16A, the controller 100 moves the sheet bundle Pb in the main scanning direction to a position where the release claw 29 is away from the binding position S3 as illustrated in FIGS. 15B and 16B, before retracting the end fences 25L and 25R in step S505 of FIG. 8. In other words, according to the third and fourth modifications, the controller 100 causes the crimp binder 27 to crimp and bind the sheet bundle Pb in step S506 of FIG. 8 after relatively moving the release claw 29 and the sheet bundle Pb in the main scanning direction so that the release claw 29 is away from the binding position S3, as illustrated in FIGS. 15C and 16C.

Figure 15C:
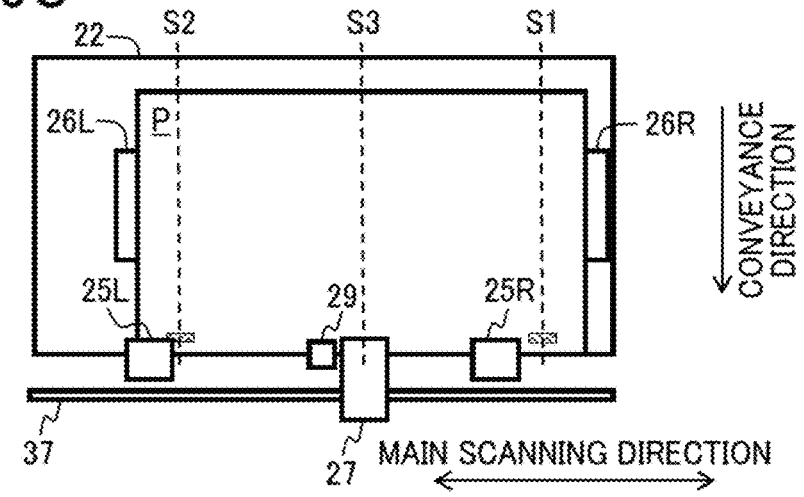

According to the third modification illustrated in FIGS. 15A to 15C, the controller 100 moves the side fences 26L and 26R in one of the main scanning directions (rightward in the example of FIGS. 15A to 15C) relative to the internal tray 22. As a result, the sheet bundle Pb is moved in the main scanning direction on the internal tray 22. The relative movement of the release claw 29 to a position away from the binding position S3 allows the crimp binder 27 to crimp and bind the sheet bundle Pb.

On the other hand, according to the fourth modification illustrated in FIGS. 16A to 16C, the controller 100 moves the internal tray 22 and the side fences 26L and 26R together in one of the main scanning directions (rightward in the example of FIGS. 16A to 16C). As a result, the sheet bundle Pb is moved in the main scanning direction together with the internal tray 22. The relative movement of the release claw 29 to a position away from the binding position S3 allows the crimp binder 27 to crimp and bind the sheet bundle Pb.

According to the third and fourth modifications, the binding position is crimped and bound by the crimp binder 27 even when the release claw 29 that does not move in the main scanning direction overlaps the binding position. As a result, a preferred binding strength is obtained for the sheet bundle Pb. According to the third modification, since the side fences 26L and 26R are moved while the internal tray 22 is fixed, an assembly for moving the internal tray 22 may be omitted. On the other hand, according to the fourth modification, since the internal tray 22, the side fences 26L and 26R, and the sheet bundle Pb are moved together, the sheet bundle Pb is prevented from being bent on the internal tray 22.

The embodiments of the present disclosure are applied to the crimp binder 27 that executes the edge binding as described above. However, the embodiments of the present disclosure may be applied to the saddle binder 33 that executes the saddle binding.

The control method described above may be implemented by, for example, a program. In other words, the control method may be executed by a computer causing an arithmetic device, a storage device, an input device, an output device, and a control device to operate in cooperation with each other based on a program. The program may be written in, for example, a storage device or a storage medium and distributed. Alternatively, the program may be distributed through, for example, an electric communication line.

Now, a description is given of some aspects of the present disclosure. According to a first aspect, a medium processing apparatus includes a conveyor, a receptacle, a conveyance-direction aligner, a crimp binder, and a controller. The conveyor conveys a sheet-shaped medium in a conveyance direction. The receptacle can hold a plurality of media, including the medium, conveyed by the conveyor. The conveyance-direction aligner contacts a downstream end, in the conveyance direction, of the plurality of media placed on the receptacle and aligns a position, in the conveyance direction, of the plurality of media. The crimp binder is disposed to face the downstream end, in the conveyance direction, of the plurality of media placed on the receptacle to press and deform a binding position on the plurality of media of which the position in the conveyance direction is aligned by the conveyance-direction aligner, to bind the plurality of media. The controller controls operations of the conveyor, the conveyance-direction aligner, and the crimp binder. The conveyance-direction aligner and the crimp binder are movable in a main scanning direction orthogonal to each of the conveyance direction and a thickness direction of the medium placed on the receptacle. The controller determines whether the conveyance-direction aligner overlaps the binding position when the receptacle is viewed in the thickness direction. In a case where the controller determines that the conveyance-direction aligner overlaps the binding position when the receptacle is viewed in the thickness direction, the controller moves the conveyance-direction aligner in the main scanning direction to a position away from the binding position. The controller then causes the crimp binder to crimp and bind the plurality of media.

According to a second aspect, the medium processing apparatus of the first aspect further includes a pair of conveyance-direction aligners including the conveyance-direction aligner. The pair of conveyance-direction aligners is arranged opposite each other across a center position, in the main scanning direction, of the plurality of media. The controller increases or decreases an interval between the pair of conveyance-direction aligners while maintaining the pair of conveyance-direction gigglers at equal distances from the center position.

According to a third aspect, in the medium processing apparatus of the first or second aspect, the controller causes the crimp binder to sequentially crimp and bind a plurality of binding positions, including the binding position, arranged at given intervals in the main scanning direction.

According to a fourth aspect, in the medium processing apparatus of the third aspect, the controller changes the intervals between the plurality of binding positions depending on a width of the plurality of media in the main scanning direction.

According to a fifth aspect, in the medium processing apparatus of the third or fourth aspect, the controller causes the crimp binder to crimp and bind at least one binding position of the plurality of binding positions, the at least one binding position being away from the conveyance-direction aligner. The controller then moves the conveyance-direction aligner in the main scanning direction.

According to a sixth aspect, in the medium processing apparatus of any one of the third to fifth aspects, the intervals between the plurality of binding positions are greater than 0 mm and less than 5 mm.

According to a seventh aspect, the medium processing apparatus of any one of the first to sixth aspects further includes a releaser that contacts the downstream end, in the conveyance direction, of the plurality of media and moves upstream in the conveyance direction to release the plurality of media crimped and bound from the receptacle. The controller determines whether the releaser overlaps the binding position when the receptacle is viewed in the thickness direction. In a case where the controller determines that the releaser overlaps the binding position when the receptacle is viewed in the thickness direction, the controller relatively moves the releaser and the plurality of media to cause the releaser to be away from the binding position. The controller then causes the crimp binder to crimp and bind the binding position.

According to an eighth aspect, the medium processing apparatus of the seventh aspect further includes a pair of width-direction aligners that contacts opposed ends, in the main scanning direction, of the plurality of media and moves in the main scanning direction to align a position, in the main scanning direction, of the plurality of media. The controller determines whether the releaser overlaps the binding position when the receptacle is viewed in the thickness direction. In a case where the controller determines that the releaser overlaps the binding position when the receptacle is viewed in the thickness direction, the controller moves the pair of width-direction aligners in the main scanning direction relative to the receptacle to move the plurality of media on the receptacle in the main scanning direction.

According to a ninth aspect, the medium processing apparatus of the seventh aspect further includes a pair of width-direction aligners that contacts opposed ends, in the main scanning direction, of the plurality of media and moves in the main scanning direction to align a position, in the main scanning direction, of the plurality of media. The controller determines whether the releaser overlaps the binding position when the receptacle is viewed in the thickness direction. In a case where the controller determines that the releaser overlaps the binding position when the receptacle is viewed in the thickness direction, the controller moves the receptacle and the pair of width-direction aligners together in the main scanning direction to move the plurality of media together with the receptacle in the main scanning direction.

According to a tenth aspect, in the medium processing apparatus of any one of the first to ninth aspects, the controller moves the conveyance-direction aligner in the main scanning direction to a position away from the binding position while the plurality of media is fixed to the receptacle.

According to an eleventh aspect, the medium processing apparatus of the tenth aspect further includes a pair of width-direction aligners that contacts opposed ends, in the main scanning direction, of the plurality of media and moves in the main scanning direction to align a position, in the main scanning direction, of the plurality of media. The controller moves the conveyance-direction aligner in the main scanning direction while an interval between the pair of width-direction aligners is smaller than a width of the medium in the main scanning direction.

According to a twelfth aspect, the medium processing apparatus of the tenth aspect further includes a contact and separation device that comes into contact with and separates from an uppermost surface of the plurality of media. The controller moves the conveyance-direction aligner in the main scanning direction while the contact and separation device is in contact with the uppermost surface of the plurality of media.

According to a thirteenth aspect, the medium processing apparatus of any one of the first to twelfth aspects further includes a drive source and a driving force transmission assembly that moves the conveyance-direction aligner and the crimp binder in the main scanning direction by the driving source.

According to a fourteenth aspect, the medium processing apparatus of any one of the first to twelfth aspects further includes a first driving source that moves the conveyance-direction aligner in the main scanning direction and a second driving source that moves the crimp binder in the main scanning direction.

According to a fifteenth aspect, an image forming system comprising an image forming apparatus and the medium processing apparatus of any one of the first to fourteenth aspects. The image forming apparatus forms an image on a medium. The medium processing apparatus crimps and binds the plurality of media on each of which the image is formed by the image forming apparatus.

According to a sixteenth aspect, a medium processing method includes determining whether a conveyance-direction aligner overlaps a binding position when a receptacle is viewed in a thickness direction of a medium, moving the conveyance-direction aligner in a main scanning direction to a position away from the binding position based on a determination that the conveyance-direction aligner overlaps the binding position when the receptacle is viewed in the thickness direction of the medium, the main scanning direction being a direction orthogonal to each of a conveyance direction of the medium and the thickness direction of the medium placed on the receptacle, and moving crimp binder in the main scanning direction and causing the crimp binder to crimp and bind a plurality of media including the medium.

According to a seventeenth aspect, a non-transitory recording medium stores a plurality of instructions which, when executed by one or more processors, causes the processors to perform a medium processing method. The method includes determining whether a conveyance-direction aligner overlaps a binding position when a receptacle is viewed in a thickness direction of a medium, moving the conveyance-direction aligner in a main scanning direction to a position away from the binding position based on a determination that the conveyance-direction aligner overlaps the binding position when the receptacle is viewed in the thickness direction of the medium, the main scanning direction being a direction orthogonal to each of a conveyance direction of the medium and the thickness direction of the medium placed on the receptacle, and moving crimp binder in the main scanning direction and causing the crimp binder to crimp and bind a plurality of media including the medium.

According to one aspect of the present disclosure, selected positions in a main scanning direction on a bundle of media placed on a tray can be crimped and bound, and thus a preferred binding strength can be obtained.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. It is therefore to be understood that the disclosure of this patent specification may be practiced otherwise by those skilled in the art than as specifically described herein and such modifications and alternatives are within the technical scope of the appended claims.

Any one of the above-described operations may be performed in various other ways, for example, in an order different from the one described above.

The functionality of the elements disclosed herein may be implemented using circuitry or processing circuitry which includes general purpose processors, special purpose, processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A medium processing apparatus comprising:

a conveyor including a conveyance roller configured to convey a sheet-shaped medium in a conveyance direction;

a tray configured to hold the medium conveyed by the conveyor;

a conveyance-direction fence configured to contact a downstream end, in the conveyance direction, of the medium placed on the tray and aligns a position, in the conveyance direction, of the medium;

a crimp binder disposed to face the downstream end, in the conveyance direction, of the medium placed on the tray to press and deform a binding position on a plurality of media, including the medium, of which the position in the conveyance direction is aligned by the conveyance-direction fence, to bind the plurality of media;

a pair of width-direction fences configured to contact opposed ends, in a main scanning direction, of the plurality of media and move in the main scanning direction to align a position, in the main scanning direction, of the plurality of media, the main scanning direction being orthogonal to each of the conveyance direction and a thickness direction of the medium placed on the tray; and circuitry configured to control operations of the conveyor, the conveyance-direction fence, and the crimp binder, the conveyance-direction fence and the crimp binder being movable in the main scanning direction, the circuitry being configured to:

determine whether the conveyance-direction fence overlaps the binding position when the tray is viewed in the thickness direction;

move the conveyance-direction fence in the main scanning direction to a position away from the binding position while the plurality of media is fixed to the tray, in a case where the circuitry determines that the conveyance-direction fence overlaps the binding position when the tray is viewed in the thickness direction; and cause the crimp binder to crimp and bind the plurality of media, and the circuitry being further configured to move the conveyance-direction fence in the main scanning direction while the opposed ends of the plurality of media contact the pair of width-direction fences.

2. The medium processing apparatus according to claim 1, further comprising a pair of conveyance-direction fences including the conveyance-direction fence, the pair of conveyance-direction fences arranged opposite each other across a center position, in the main scanning direction, of the plurality of media, wherein the circuitry is configured to increase or decrease an interval between the pair of conveyance-direction fences while maintaining the pair of conveyance-direction fences at equal distances from the center position.

3. The medium processing apparatus according to claim 1, wherein the circuitry is configured to cause the crimp binder to sequentially crimp and bind a plurality of binding positions, including the binding position, arranged at given intervals in the main scanning direction.

4. The medium processing apparatus according to claim 3, wherein the circuitry is configured to change the intervals between the plurality of binding positions depending on a width of the plurality of media in the main scanning direction.

5. The medium processing apparatus according to claim 3, wherein the circuitry is configured to cause the crimp binder to crimp and bind at least one binding position of the plurality of binding positions, the at least one binding position being away from the conveyance-direction fence, and move the conveyance-direction fence in the main scanning direction.

6. The medium processing apparatus according to claim 3, wherein the intervals between the plurality of binding positions are greater than 0 mm and less than 5 mm.

7. The medium processing apparatus according to claim 1, further comprising a contact configured to contact the downstream end, in the conveyance direction, of the plurality of media and move upstream in the conveyance direction to release the plurality of media crimped and bound from the tray, wherein the circuitry is configured to:

determine whether the contact overlaps the binding position when the tray is viewed in the thickness direction;

relatively move the contact and the plurality of media to cause the contact to be away from the binding position in a case where the circuitry determines that the contact overlaps the binding position when the tray is viewed in the thickness direction; and cause the crimp binder to crimp and bind the binding position.

8. The medium processing apparatus according to claim 7, wherein the circuitry is configured to:

determine whether the contact overlaps the binding position when the tray is viewed in the thickness direction; and move the pair of width-direction fences in the main scanning direction relative to the tray to move the plurality of media on the tray in the main scanning direction, in a case where the circuitry determines that the contact overlaps the binding position when the tray is viewed in the thickness direction.

9. The medium processing apparatus according to claim 7, wherein the circuitry is configured to:

determine whether the contact overlaps the binding position when the tray is viewed in the thickness direction; and move the tray and the pair of width-direction fences together in the main scanning direction to move the plurality of media together with the tray in the main scanning direction, in a case where the circuitry determines that the contact overlaps the binding position when the tray is viewed in the thickness direction.

10. The medium processing apparatus according to claim 1, further comprising a contact and separation device including a tapping roller configured to come into contact with and separate from an uppermost surface of the plurality of media, wherein the circuitry is configured to move the conveyance-direction fence aligner in the main scanning direction while the contact and separation device is in contact with the uppermost surface of the plurality of media.

11. The medium processing apparatus according to claim 1, further comprising:

a drive source; and a driving force transmission assembly including a pulley and a timing belt configured to move the conveyance-direction fence and the crimp binder in the main scanning direction by the driving source.

12. The medium processing apparatus according to claim 1, further comprising:

a first driving source including a first motor configured to move the conveyance-direction fence in the main scanning direction; and a second driving source including a second motor configured to move the crimp binder in the main scanning direction.

13. An image forming system comprising:

the medium processing apparatus according to claim 1, the medium processing apparatus being configured to crimp and bind the plurality of media on each of which an image is formed.

* * * * *